US008039184B2

(12) United States Patent
Anno et al.

(10) Patent No.: US 8,039,184 B2
(45) Date of Patent: Oct. 18, 2011

(54) TWO-COMPONENT DEVELOPER

(75) Inventors: Masahiro Anno, Tokyo (JP); Masahiko Nakamura, Tokyo (JP); Tsuyoshi Uchida, Tokyo (JP); Kenichi Onaka, Tokyo (JP); Junya Onishi, Tokyo (JP); Naoya Tonegawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 446 days.

(21) Appl. No.: 12/398,242

(22) Filed: Mar. 5, 2009

(65) Prior Publication Data

US 2009/0233205 A1 Sep. 17, 2009

(30) Foreign Application Priority Data

Mar. 14, 2008 (JP) ..... 2008-065584

(51) Int. Cl.
*G03G 9/08* (2006.01)

(52) U.S. Cl. ..... 430/108.24; 430/108.6; 430/111.35; 430/111.4

(58) Field of Classification Search ..... 430/108.24, 430/108.6, 111.35, 111.4
See application file for complete search history.

(56) References Cited

U.S. PATENT DOCUMENTS

2003/0180644 A1* 9/2003 Nanya et al. ..... 430/108.22
2008/0038653 A1* 2/2008 Yamazaki et al. ..... 430/106.2

* cited by examiner

*Primary Examiner* — Hoa Le
(74) *Attorney, Agent, or Firm* — Lucas & Mercanti, LLP

(57) ABSTRACT

Provided is a two-component developer with which degradation of development is inhibited even in the case of prolonged use, and thereby a high quality image exhibiting high resolution and sufficient image density can be formed for a long duration. Also disclosed is a two-component developer possessing a carrier and a toner, wherein the carrier in which magnetic material powder is dispersed in a binder resin containing a phenol formaldehyde resin has a shape coefficient SF-1 of 1.0-1.2, a shape coefficient SF-2 of 1.1-2.5 and a volume-based median particle diameter of 10-100 μm, and the toner possesses a colored particle and an external additive particle, wherein the external additive particle comprises a titanic acid compound and iron, and the iron content is 100-1,000 ppm, based on the titanic acid compound.

5 Claims, No Drawings

TWO-COMPONENT DEVELOPER

This application claims priority from Japanese Patent Application No. 2008-065584 filed on Mar. 14, 2008, which is incorporated hereinto by reference.

TECHNICAL FIELD

The present invention relates to a two-component developer.

BACKGROUND

In recent years, an electrophotographic system image forming method has been utilized as an alternative to preparation of original images or a so-called printing rather than simple copying, with the developments in network such as easy transmission of specifically data in a digital mode, and its application range has been expanded. Consequently, in this technique, formation of a stable image for a long duration is demanded, and longer frequency to change a developer is also demanded. On the other hand, in order to form a stable image in the electrophotographic system image forming method, a two-component developer composed of a carrier and a toner is preferably to be utilized. It would appear that this can reliably provide charge to the toner since the carrier exhibits charge providing performance, and further, quick charge-rising can be obtained since many frictional electrification-providing regions are present, resulting in suitability for high-speed development.

However, when using a two-component developer in the electrophotographic system image forming method, there appear problems such that degradation of the carrier is produced via attachment of toner components to the carrier, and external additive particles embedded in the toner are produced via repeated collision of the carrier with the toner.

In order to solve this problem, it is proposed that stress to the toner is reduced by employing a so-called weight-saved resin dispersion type carrier as a carrier (refer to Patent Documents 1 and 2). This resin dispersion type carrier is one in which low specific gravity is realized by dispersing magnetic particles in a binder resin, and specifically, since a resin dispersion type carrier prepared by a polymerization method is formed in spherical shape, and has reduced protrusions, stress to the toner is effectively reduced. And, among the resin dispersion type carriers obtained via the polymerization method, specifically, a carrier, with which a phenol formaldehyde resin exhibiting advantageous properties such as high hardness and excellent durability is used as a binder resin, tends to be preferably utilized.

However, even though using the resin dispersion type carrier employing such the phenol formaldehyde resin, there is another problem such that degradation of development is still generated when using the carrier for a long duration.

(Patent Document 1) Japanese Patent O.P.I. Publication No. 2002-214842.

(Patent Document 2) Japanese Patent O.P.I. Publication No. 2005-352473.

SUMMARY

The present invention was made on the basis of the above-described situation, and it is an object of the present invention to provide a two-component developer with which degradation of development is inhibited even in the case of prolonged use, and thereby a high quality image exhibiting high resolution and sufficient image density can be formed for a long duration.

DESCRIPTION OF THE PREFERRED EMBODIMENTS

Problem occurrence produced when using a resin dispersion type carrier was analyzed in detail by the inventors, whereby charge buildup of the resin dispersion type carrier is generated, so that a charging amount is accordingly increased via excessive charge buildup during prolonged use, and this presumably leads to the reason of degraded developability. The reason why the charge buildup of the resin dispersion type carrier is generated is to be as follows. That is, since the resin dispersion type carrier is made of a resin, it generally exhibits high insulation, and the charge can be diffused inside because of a conductive core present inside in the case of a resin-coating type carrier, but in the case of the resin dispersion type carrier, charge buildup is easy to be generated since the resin (one exhibiting insulation) is fully dispersed.

After considerable effort during intensive studies on the basis of the above-described situation, the inventors have found out that prevention of excessive electrification to external additive particles is a key to inhibit charge buildup to the carrier, and thereby the present invention has been accomplished.

A two-component developer of the present invention comprising a toner and a carrier, wherein the carrier in which magnetic material powder is dispersed in a binder resin containing a phenol formaldehyde resin has a shape coefficient SF-1 of 1.0-1.2, a shape coefficient SF-2 of 1.1-2.5 and a volume-based median particle diameter of 10-100 μm, and wherein the toner comprises a colored particle and an external additive particle, the external additive particle comprising a titanic acid compound having an iron content of 100-1,000 ppm.

As to the two-component developer of the present invention, the external additive particle preferably has a BET specific surface area of 5-20 $m^2/g$.

Further, it is preferable that the external additive particle has a number average primary particle diameter of 50-2000 nm, and an sd value of the number average primary particle diameter represented by the following Equation (1) is 250 nm or less.

Equation (1): sd value (nm)=$(d_1 84-d_1 16)/2$, where $d_1 84$ and $d_1 16$ are particle diameters at which a cumulative curve obtained by setting the total when measuring the number average primary particle diameter to 100% becomes 84% and 16%, respectively.

Further, the toner preferably has an acid value of 3-35 mg·KOH/g.

Further, as to the two-component developer of the present invention, the titanic acid compound can be calcium titanate or magnesium titanate.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Next, the present invention will now be described in detail.

[Two-Component Developer]

The two-component developer of the present invention is a two-component developer continuously supplied into a developing process in an image forming method by which an electrostatic latent image formed on an electrostatic latent image carrier is visualized with the two-component developer composed of a toner and a carrier, wherein the foregoing toner contains at least a colored particle and an external additive particle, and as to the external additive particle possessing a titanic acid compound and iron, the content of iron measured via inductively-coupled plasma emission spectroscopy (referred to also as "iron content") is 100-1000 ppm, and preferably 100-500 ppm, based on the titanic acid compound. As described below, such the external additive particle is referred to also as "specific external additive particle".

[Specific External Additive Particle]

Specific examples of the titanic acid compound include calcium titanate, magnesium titanate, strontium titanate, barium titanate, aluminum titanate, zirconium titanate, sodium titanate and so forth Of these, calcium titanate and sodium titanate are preferable, but strontium titanate and barium titanate are unfavorable in view of safety. Calcium titanate is also preferable when using it as the external additive particle for a negatively chargeable toner.

The iron content in the specific external additive particle is measured by an inductively-coupled plasma emission spectroscopy apparatus (ICP-OES). The specific measuring method is as follows. That is, after 1 g of a measured sample (specific external additive particles) is put into a dried 200 ml conical beaker, 20 ml of a sulfuric acid is added as a decomposition agent, and the resulting is subjected to a micro wave decomposing treatment for micro wave decomposition employing a closed type micro wave wet process decomposing apparatus "MLS-1200MEGA", manufactured by Milestone Microwave Laboratory System, washing was conducted. In this case, the micro wave decomposition is to be kept conducting until confirming absence of the insoluble matter. Next, the resulting solution of decomposed matter is transferred into a 100 ml messflask, and distilled water is added up to the marking line to make 100 ml and to prepare a sample solution. Then, 25 ml of the sample solution is put into another 100 ml messflask, and distilled water is added up to the marking line to make 100 ml and to prepare a solution for analysis. The solution for analysis is measured in Fe wavelength of 238.204 nm employing an inductively-coupled plasma emission spectroscopy apparatus to conduct quantitative analysis as an iron ion by referring to a calibration curve corresponding to compositions of the sample.

(Preparation of Calibration Curve)

As to the calibration curve, a reference solution as a sample adjusted so as to give a Fe content of each of 0 ppm, 250 ppm, 500 ppm, 750 ppm and 1,000 ppm in a titanix acid compound is prepared in a method of preparing the above-described solution for analysis and measured in Fe wavelength of 238.204 nm employing an inductively-coupled plasma emission spectroscopy apparatus after diluting this reference solution, and the calibration curve can be obtained by drawing a curve for calibration through the above-described 5 points. When the titanic acid compound is calcium titanate, a calibration curve of calcium titanate can be made by employing calcium titanate as a sample. Also, in the case of another titanic acid compound in which a metal component bonded to a titanic acid component is not calcium, a calibration curve can be similarly obtained, except that a metal component is replace by strontium, magnesium or the like, for example. These may be used according to compositions of the sample to measure an Fe content (kinds of the metal component bonded to the titanic acid component).

As to specific external additive particles, the specific external additive particles exhibit inhibition of excessive electrification when an Fe content measured by an inductively-coupled plasma emission spectroscopy apparatus falls within the range between 100 ppm and 1000 ppm, whereby the resulting toner exhibits high electrification environment stability.

As to specific external additive particles, in the case of an Fe content of less than 100 ppm, the resulting toner exhibits low charge-rising ability, and further, the saturation charging amount of the resulting toner becomes high, resulting in low developability. On the other hand, in cases where an Fe content measured by an inductively-coupled plasma emission spectroscopy apparatus exceeds 1000 ppm, the resulting toner exhibits low charge-holding ability, and the charging amount becomes low specifically at high temperature and high humidity, resulting in low developability as well as low transferability.

[Average Particle Diameter of External Additive Particles]

The specific external additive particles preferably have a number average primary particle diameter of 50-2000 nm, and more preferably have a number average primary particle diameter of 50-400 nm. The sd value of the number average primary particle diameter preferably exhibits a sharp distribution in a particle diameter distribution of 250 nm or less, more preferably exhibits a sharp distribution in a particle diameter distribution of 200 nm or less, and still more preferably exhibits a sharp distribution in a particle diameter distribution of 150 nm or less in the case of the sd value being in the above-described range, each of specific external additive particles with respect to the toner when used exhibits low fluctuation in charge-contributing performance, and the resulting toner tends to possess high uniformity. In addition, conventionally known calcium titanate particles and magnesium titanate particles do not exhibit such the number average primary particle diameter and sharp particle diameter distribution.

The number average primary particle diameter of specific external additive particles is measured by a scanning electron microscope (SEM). Specifically, a SEM micrograph at a magnification of 30,000 times is read by a scanner, external additive particles present on the toner surface in the SEM micrograph image is subjected to a binarization treatment with an image processing analyzer LUZEX AP, manufactured by NERCO Corp., the horizontal Feret diameters of 100 particles per one kind of external additive particles are calculated, and the mean value is designated as a number average primary particle diameter. In addition, in cases where the number average primary particle diameter of external additive particles is a small diameter, and they are present on the toner surface as an aggregate, a particle diameter of primary particles to form an aggregate is to be measured. Further, a cumulative curve is prepared from each particle diameter (Feret diameter) obtained via determination of the 100 external additive particles when measuring the above-described number average primary particle diameter to calculate the sd value. That is, the cumulative curve is prepared by using the horizontal axis as the particle diameter and the vertical axis as the accumulation (%). When the maximal value of the cumulative curve is set to 100%, particle diameters, at which the cumulative curve becomes 84% and 16%, are set to $d_1 84$ and $d_1 16$, respectively, and these values are substituted into the following Equation (1) to calculate the sd value.

$$sd \text{ value (nm)} = (d_1 84 - d_1 16)/2 \qquad \text{Equation (1)}$$

The number average primary particle diameter of specific external additive particles and particle size distribution (sd value) can be adjusted by controlling a mixture ratio of an element source of the specific metal element with a titanium oxide source, concentration of the titanium oxide source at an initial stage of reaction in a reaction process, temperature and an addition speed during addition of an aqueous alkali solution and so forth in the following manufacturing method described in detail. They can be easily adjusted by controlling the addition speed of an aqueous alkali solution since it largely influences a particle diameter of the resulting titanic acid compound particle. In addition, the smaller the addition speed of an aqueous alkali solution, the larger particle diameter of the external additive particle can be obtained. The larger the addition speed of an aqueous alkali solution, the smaller particle diameter of the external additive particle can be obtained.

[Specific Surface Area of External Additive Particle]

The specific external additive particle preferably has a BET specific surface area of 5-20 $m^2/g$, more preferably has a BET specific surface area of 10-18 $m^2/g$, and still more preferably has a BET specific surface area of 10-16 $m^2/g$. In addition, the BET specific surface area is a specific surface area calculated via application of a BET adsorption isotherm equation from an adsorption amount of molecules of gas having a known adsorption occupying area like nitrogen gas, for example. Embedding of the external additive particles in colored particles and releasing from the colored particle surface are not generated by falling the BET specific surface area of the specific external additive particle within the above-described range, whereby the environment to act stably as the specific external additive particle can be formed.

The BET specific surface area of the specific external additive particle is a value measured by a multi-point method (7 points method) employing an automatic specific surface area measuring apparatus "GEMINI 2360" manufactured by Shimadzu Micromeritics Corporation. Specifically, 2 g of specific external additive particles are filled in a straight sample cell, and the inside of the cell is replaced by nitrogen gas (purity: 99.999%) for a pretreatment. Subsequently, nitrogen gas (purity: 99.999%) is adsorbed and desorbed onto the specific external additive particles to conduct calculation with a measuring apparatus main body.

[Acid Value of Toner]

In the present invention, the toner preferably has an acid value of 3-35 mg·KOH/g, and more preferably has an acid value of 7-25 mg·KOH/g. When the toner has an acid value of 3-35 mg·KOH/g, both charge-holding ability of the toner and charge-rising ability of the toner can be obtained even at high temperature and high humidity or at low temperature and low humidity.

Herein, the acid value of toner is specified by the number of mg of potassium hydroxide employed to neutralize a free fatty acid, a resin acid or the like having a carboxyl group contained in 1 g of toner. A sample (toner) is dissolved in a mixture solvent of benzene and ethanol, and a potassium hydroxide solution having a known concentration is dropped to calculate the acid value of toner from the neutralization amount. Specifically, it is measured in accordance with JIS K 0070-1992.

When a binder resin to form colored particles constituting the toner is a resin obtained via addition-polymerization reaction, the acid value of toner can be controlled, for example, by adjusting a composition ratio of an acid component containing a carboxyl group such as an acrylic acid based monomer or the like, or by adjusting a constituting ratio of a monomer containing an acid component subjected to polymerization reaction during preparation of toner. Further, when the binder resin is a resin obtained via polycondensation reaction, it can be adjusted, for example, by inhibiting progress of cross-linkage reaction via use of a monomer containing a polyfunctional acid component such as a trimellitic acid or the like; by adjusting a constituting ratio of a monomer containing an acid component subjected to polymerization reaction during preparation of toner, and a monomer containing an alcohol component; by changing the condition of polymerization reaction; or the like.

[Addition Ratio of External Additive Particle].

As to an addition ratio of external additive particles, specific external additive particles preferably have an addition ratio of 0.1-10.0% by weight, more preferably have an addition ratio of 0.3-5.0% by weight, and still more preferably have an addition ratio of 0.4-2.0% by weight, based on the weight of colored particles. In the case of specific external additive particles having an addition ratio of less than 0.1% by weight, high electrification environment stability and sop forth tend not to be obtained. On the other hand, in the case of specific external additive particles having an addition ratio exceeding 10.0% by weight, a releasing phenomenon and so forth of external additive particles are generated, whereby scratches caused by these released external additive particles tend to be generated to an electrostatic latent image carrier such as a photoreceptor or the like.

[Method of Manufacturing External Additive Particle]

A method of manufacturing specific external additive particles contained in a toner for a two-component developer of the present invention is not specifically limited, but provided can be a method of manufacturing a perovskite-type titanic acid compound with an ambient-pressure heat reaction method, for example. It can be prepared via reaction conducted at 50° C. while adding an aqueous alkali solution into a mixture solution containing a titanium oxide source and a specific metal element such as strontium, magnesium, calcium, barium, Aluminum, zirconium or sodium as a compound reacted with a titanium component in this titanium oxide source.

As a titanium oxide source, a mineral acid deflocculation product of a hydrolysate of a titanium compound is provided. Preferably used is specifically, a mineral acid deflocculation product deflocculated by adjusting a metatitanic acid having a $SO_3$ content of not more than 1.0% by weight, or preferably not more than 0.5% by weight, obtained via a sulfuric acid method, with a hydrochloric acid so as to give a pH of 0.8-1.5. By using such the mineral acid deflocculation product, the resulting titanic acid compound particles lead to a favorable particle size distribution (ad value). In addition, as to the after-mentioned external additive particle preparation examples 1-18, a deflocculation treatment and a pulverization treatment are carried out to reduce the particle size. Specifically, as the effects produced by the foregoing, the deflocculation treatment carried out for a longer duration is possible to reduce the number average particle diameter, and the pulverization treatment carried out for a longer duration is also possible to minimize the sd value (sharp in shape of particle diameter distribution). The particles are subjected to the deflocculation treatment to reduce the particle size, together with the pulverization treatment to make the sd value to be smaller, but the sd value is to be optimized via further application of the pulverization treatment (external additive particle preparation examples 8 and 9). Further, as an element source for a specific metal element, usable is a water-soluble acidic compound such as a nitric acid compound, a hydrochloric acid, a carbonic acid compound or the like containing the specific metal element. Further, an aqueous caustic alkali solution is provided as an aqueous alkali solution, and specifically, an aqueous sodium hydroxide solution is preferably used. As to an element source mixture ratio of a specific metal element to a titanium oxide source, a molar ratio ($XO/TiO_2$)

of 0.9-1.4 is preferable, a molar ratio ($XO/TiO_2$) of 0.95-1.15 is more preferable, and a molar ratio ($XO/TiO_2$) of 1.0-1.15 is still more preferable, wherein the specific metal element is represented by X.

In the reaction process, incorporation of carbon dioxide gas like reaction at nitrogen gas atmosphere in order to prevent generation of a carbonic acid compound should be prevented. Further, in the reaction process, the higher the temperature during addition of an aqueous alkali solution, the better the crystallinity is, but the suitable temperature id practically 50-101° C. Further, the addition speed of the aqueous alkali solution depends on a primary particle diameter of intended titanic acid compound particles, but it is preferably 0.001-1.0 equivalent weight/hour, and more preferably 0.005-0.5 equivalent weight/hour, based on stock raw material, for example. The addition speed of the aqueous alkali solution may vary in the middle of addition depending on the purpose.

In the above-described manufacturing method, an introduction method of an iron atom is not limited, and any method may be used, but it is preferable, for example, to add a material containing an iron component in a mixture solution before adding an alkali solution during a reaction process. The material containing an iron component is preferably utilized by dissolving water-soluble ferrous chloride $FeCl_2$ and ferric chloride $FeCl_3$, anhydrides or hydrates of ferrous sulfate $FeSO_4$ and ferric sulfate $Fe_2(SO_4)_3$ and so forth in water, and powder such as iron oxide powder or the like, and slurry are also usable.

Further, the titanic acid compound particles are preferably burned at 300-1200° C., for example. Crystallinity is improved by this calcinations, whereby the resulting external additive particles exhibit excellent electrification environment stability.

The resulting titanic acid compound particles may be used as they are as external additive particles, but the titanic acid compound particles are preferably subjected to a hydrophobization treatment in order to adjust electrification of the resulting toner and to improve electrification environment stability. AS the hydrophobization treatment method, there are provided the following methods such as a dry method in which a hydrophobizing agent or a diluent is added via dropping or spraying, and sufficiently mixed while forcibly stirring titanic acid compound particles in the form of powder with a blender by employing the hydrophobizing agent singly or the diluent in which it is dissolved in an organic solvent such as tetrahydrofran (THF), toluene, ethyl acetate, methylethyl ketone, acetone or the like, for example; a method in which titanic acid compound particles are immersed in a solution in which a hydrophobizing agent is dissolved in an organic solvent, and sufficiently mixed; and a wet method by which a predetermined hydrophobizing agent is dispersed in an aqueous medium, titanic acid compound particles are immersed in the aqueous medium in which this hydrophobizing agent is dispersed and sufficiently mixed, and the resulting is subsequently dried, and pulverized. These dry and wet methods may also be used in combination. Of these, as a treating method, preferable is a wet method by which a hydrophobizing agent is dispersed in an aqueous medium to immerse titanic acid compound particles in view of improved evenness, safety and cost of a hydrophobization treatment conducted for each particle by using a titanic acid compound, and more preferable is a wet method by which a hydrophobization treatment is conducted in an aqueous medium employing one at an aqueous emulsion state as a hydrophobizing agent.

Examples of the hydrophobizing agent employed in the hydrophobization treatment include inorganic oxides such as $SiO_2$, $Al_2O_3$ and so forth; silane based coupling agents such as chlorosilane, alkylsilane, alkoxysilane, silazane and so forth; various coupling agents such as a titanate based coupling agent, an aluminum based coupling agent, a zircoaluminate based coupling agent and so forth; silicone oil; a stearic acid and so forth. As the hydrophobizing agent, silicone oil is specifically preferable Further, specific examples of those suitably usable as aqueous emulsion of silicone oil include dimethylpolysiloexane based emulsion such as SM7036EX, SM7060EX, SM8706EX or the like (produced by Toray Dow Corning Silicone Co., Ltd.); amino-modified silicone emulsion such as SM8704, SM8709, BY22-819 or the like (produced by Toray Dow Corning Silicone Co., Ltd.); carboxy-modified silicone emulsion such as BY22-840 or the like (produced by Toray Dow Corning Silicone Co., Ltd.); and phenylmethylsilicone emulsion such as SM8627EX or the like (produced by Toray Dow Corning Silicone Co., Ltd.).

An addition content of the hydrophobizing agent depends on kinds of titanic acid compounds constituting external additive particles, but the hydrophobizing agent preferably has an addition content of 0.1-5.0% by weight, and more preferably has an addition content of 0.2-3.0% by weight, based on the external additive particles. In the case of an addition content of the hydrophobizing agent of less than 0.1% by weight, no sufficient hydrophobizing effect can be obtained. On the other hand, in the case of an addition content of the hydrophobizing agent exceeding 5.0% by weight, an excessive amount of the hydrophobizing agent is added with respect to external additive particles to be treated, the hydrophobizing agent not contributing to the hydrophobization treatment conducted for the external additive particle surface is ejected together with a dispersing medium, and the hydrophobizing agent-to-hydrophobizing agent is also coagulated, whereby the inside of a manufacturing apparatus, and an image forming apparatus tend to be contaminated.

[Other External Additive Particles]

External additive particles contained in the toner for two-component developer of the present invention are not limited only to specific external additive particles as described above, and other external additive particles are used in combination. When other external additive particles are used in combination, the total external additive particles preferably have an addition content of 0.1-10% by weight, based on colored particles. Among those, the above-described specific external additive particles more preferably have an addition content of 0.1-10% by weight, based on colored particles.

As other external additive particles, usable are various inorganic particles, organic particles, and lubricants such as a titanium acid compound, a stearic acid metal salt and so forth. The inorganic particles such as silica, titania, alumina and the like, for example, are preferably used as inorganic particles. Further, these inorganic particles are preferably subjected to a hydrophobization treatment employing a silane coupling agent, a titanium coupling agent, various kinds of silicone oil or the like. Spherical organic particles having a number average primary particle diameter of 10-2000 nm are also usable. Polystyrene, polymethyl methacrylate, a styrene-methyl methacrylate copolymer or the like is usable for these organic particles. These other external additive particles may be used in combination with various materials.

[Addition Treatment of External Additive Particles]

Toner can be obtained by adding such the external additive particles described above into the colored particle to form the toner. When adding external additive particles, usable is a mechanical mixer such as a Henschel mixer, a coffee mill or the like as a mixer employed to add the external additive particles.

Such the titanic acid compound is added into colored particles, and used as the external additive particle constituting the toner as described below, but not only the titanic acid compound is used as the external additive particle, but also it can be added onto the carrier surface, and may be added into the toner as well as the carrier as the third component.

[Toner]

The toner constituting a two-component developer of the present invention is one containing a colored particle and a specific external additive particle, and the colored particle, for example, is one containing a binder resin and a colored particle.

The method of manufacturing such the toner is not specifically limited, and examples thereof include a pulverization method, a suspension polymerization method, a mini-emulsion polymerization coagulation method, an emulsion polymerization coagulation method, a dissolving-suspension method, a polyester molecule elongation method, and other known methods. Specifically, in the case of an image forming method employing a two-component developer of the present invention, even though the toner to be used is irregular in shape, it can be highly and evenly charged for a long duration, whereby images exhibiting excellent image quality can be stably formed for a long duration.

(Suspension Polymerization Method)

The suspension polymerization method is carried out as described below. That is, Toner constituting materials such as a releasing agent, a colorant and so forth, and a radical polymerization initiator are added into a radical polymerizable monomer, and these are dissolved or dispersed in the radical polymerizable monomer by a sand grinder or the like to prepare a uniform monomer dispersion. Next, the above-described monomer dispersion is added into an aqueous medium in which a dispersion stabilizer has been added in advance, and dispersed in the aqueous medium by a homomixer or an ultrasonic wave disperser to form oil droplets. Since the particle diameter of this droplet finally becomes a toner particle diameter, dispersing is conducted via control so as to form desired particles in size. The dispersed droplets preferably have a volume-based median diameter of 3-10 μm. Thereafter, polymerization is conducted by heating. After completion of the polymerization reaction, the dispersion stabilizer is removed, and the resulting is washed and dried to obtain colored particles.

[Binder Resin]

In cases where colored particles constituting the toner are prepared by the pulverization method, the dissolving-suspension method or the like, as the binder resin contained in the toner, usable are various known resins such as a vinyl based resin such as a styrene based resin, a (meth)acrylic resin, a styrene-(meth)acrylic copolymer resin, an olefin type resin or the like; a polyester based resin, a polyamide based resin, a polycarbonate based resin, polyether, a polyvinyl acetate resin, polysulfone, an epoxy resin, a polyurethane resin and a urea resin and so forth. These resins can be used singly or in combination with at least two kinds. The releasing agent, the colorant and so forth are added into the binder resin, and the resulting is kneaded by a bi-axial kneader or the like, and subsequently, pulverized and classified to obtain colored particles.

On the other hand, in cases where colored particles are manufactured by a suspension polymerization method, a mini-emulsion polymerization coagulation method, an emulsion polymerization coagulation method or the like, examples of a polymerizable monomer to obtain a resin constituting the toner include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether and vinyl ethyl ether; vinyl ketones such as vinyl methyl ketone, vinyl ethyl ketone, and vinyl hexyl ketone; N-vinyl compounds such as N-vinylcarbazole, N-vinylindole, and N-vinylpyrrolidone; vinyl compounds such as vinylnaphthalene and vinylpyridine; as well as derivatives of acrylic acid or methacrylic acid such as acrylonitrile, methacrylonitrile, and acryl amide. These vinyl based monomers may be used singly or in combination with at least two kinds.

Further, those having an ionic dissociative group usable in combination are preferable as polymerizable monomers. The polymerizable monomers having an ionic dissociative group are those having substituents such as a carboxyl group, a sulfonic acid group, and a phosphoric acid group, as the constituting groups of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, and 3-chloro-2-acid phosphoxypropyl methacrylate. Further, it is possible to prepare resins having a cross-linking structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

[Surfactant]

When manufacturing colored particles constituting toner by a suspension polymerization method, a mini-emulsion polymerization coagulation method or an emulsion polymerization coagulation method, utilized surfactants to obtain a binder resin are not specifically limited, but ionic surfactants described below are suitable. Such ionic surfactants include sulfonates (e.g., sodium dodecylbenzene sulfonate and sodium arylalkylpolyether sulfonate), sulfates (e.g., sodium dodecyl sulfate, sodium tetradecyl sulfate, sodium pentadecyl sulfate and sodium octyl sulfate), and fatty acid salts (e.g., sodium oleate, sodium laurate, sodium caprate, sodium caprylate, sodium caproate, potassium stearate and calcium oleate). Nonionic surfactants are also usable, and examples thereof include polyethylene oxide, polypropylene oxide, a combination of polypropylene oxide and polyethylene oxide, an ester or polyethylene glycol and a higher fatty acid, alkylphenol polyethylene oxide, an ester of polypropylene oxide and a higher fatty acid, and sorbitan ester. These surfactants are used as an emulsifying agent when manufacturing the toner by an emulsion polymerization method but may also be used in other processes or for other purposes.

[Dispersion Stabilizer]

When manufacturing colored particles constituting toner by a suspension polymerization method, a dispersion stabilizer made of an easily removable inorganic compound is also usable. Preferred examples of the dispersion stabilizer include tricalcium phosphate, magnesium hydroxide, hydrophilic colloidal silica and so forth, but tricalcium phosphate is specifically preferable. Since this dispersion stabilizer is easily decomposed by an acid such as a hydrochloric acid or the like, it can be easily removed from the colored particle surface.

[Polymerization Initiator]

When manufacturing colored particles by a suspension polymerization method, a mini-emulsion polymerization coagulation method or an emulsion polymerization coagulation method, a binder resin can be polymerized with a radical polymerization initiator. Specifically, oil-soluble radical polymerization initiators are usable in suspension polymerization and examples of the oil-soluble radical polymerization initiator include azo- or diazo-type polymerization initiators, e.g., 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, azobisisobutylonitrile; peroxide type polymerization initiators, e.g., benzoyl peroxide, methyl ethyl ketone peroxide, diisopropylperoxycarbonate, cumene hydroperoxide, t-butyl hyroperoxide, di-t-butyl peroxidedicumyl peroxide 2,4-dichlorobenzoyl peroxide, lauroyl peroxide, 2,2-bis-(4,4-t-butylperoxycyclohexyl)-propane, tris-(t-butylperoxy)triazine; and polymeric initiators having a side-chain of peroxide.

[Chain Transfer Agent]

When manufacturing colored particles by a suspension polymerization method, a mini-emulsion polymerization coagulation method or an emulsion polymerization coagulation method, generally employed are chain-transfer agents usable for the purpose of controlling the molecular weight of a binder resin. Chain transfer agents are not specifically limited but examples thereof include mercaptans such as n-octylmercaptan, n-decylmercaptane and tert-dodecylmercaptan; n-octyl-3-mercaptopropionic acid ester, terpinolene, carbon tetrabromide, α-methylstyrene dimmer and so forth.

[Colorant]

Commonly known inorganic or organic colorants are usable for colorants constituting colored particles. Specific colorants are as follows. Examples of black colorants include carbon black such as Furnace Black, Channel Black, Acetylene Black, Thermal Black and Lamp Black and magnetic powder such as magnetite and ferrite.

Further, examples of magenta and red colorants in the case of color image formation include C.I. Pigment Red 2, C.I. Pigment Red 3, C.I. Pigment Red 5, C.I. Pigment Red 16, C.I. Pigment Red 48, C.I. Pigment Red 53, C. I. Pigment Red 57, C. I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222 and so forth. Examples of orange or yellow colorants in the case of color image formation include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, C.I. Pigment Yellow 94, C.I. Pigment Yellow 138 and so forth. Examples of green or cyan colorants in the case of color image formation include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, C.I. Pigment Green 7 and so forth.

The foregoing colorants may be used singly or in combination with at least two kinds. The colorant preferably has an addition amount of 1-30% by weight, and preferably has an addition amount of 2-20% by weight, based on the total weight of toner.

Surface-modified colorants are also usable. Commonly known surface modifiers are usable and preferred examples thereof include a silane coupling agent, a titanium coupling agent and an aluminum coupling agent.

[Releasing Agent]

A releasing agent may be contained in a colored particle constituting toner, if desired. Various kinds of known wax are usable as the releasing agent. The releasing agent contained in the toner preferably has an addition amount of 1-30% by weight, and more preferably has an addition amount of 5-20% by weight, based on the binder resin.

[Charge Controlling Agent]

Further, a charge controlling agent may be contained in a colored particle, if desired. Usable charge controlling agents include various compounds known in the art.

[Particle Diameter of Colored Particle]

The colored particles constituting the toner particle relating to a two-component developer of the present invention preferably have a number average particle diameter of 3-8 μm. In the case of colored particles formed by a polymerization method, the particle diameter can be controlled by a coagulant concentration, the addition amount of organic solvents, a fusion time and polymer composition in the above-described method of manufacturing the toner.

A number average particle diameter falling within the range of 3-8 μm can achieve reproduction of fine lines and enhanced image quality of photographic images, and also can reduce toner consumption in comparison to the case of employing a toner having a larger particle diameter.

[Carrier]

In the case of a two-component developer of the present invention, a carrier mixed with a toner has specific shape having a shape coefficient SF-1 of 1.0-1.2, a shape coefficient SF-2 of 1.1-2.5, and a volume-based median particle diameter of 10-100 μm, and is a specific resin dispersion type carrier in which magnetic material powder is dispersed in a binder resin containing a phenol formaldehyde resin.

[Magnetic Material Powder]

As the magnetic material powder constituting a specific resin dispersion type carrier, powder made of well-known magnetic materials, for example, metal or metal oxide such as iron, ferrite represented by formula (a): $MO \cdot Fe_2O_3$, and magnetite represented by formula (b): $MFe_2O_4$, alloys composed of these metals or metal oxides, and a metal such as aluminum, lead or the like are usable, provided that in the formulas (a) and (b), M represents divalent or monovalent metal, for example, such as Mn, Fe, Ni, Co, Cu, Mg, Zn, Cd, Li or the like. These are used singly, or in combination with a plurality of kinds. Specific examples of the magnetic material powder include magnetite, γ iron oxide, Mn—Zn system ferrite, Ni—Zn system ferrite, Mn—Mg system ferrite, Ca—Mg system ferrite, Li system ferrite, Cu—Zn system ferrite and so forth. The magnetic material powder in a specific resin dispersion type carrier has a content of 40-99% by weight, and preferably has a content of 50-70% by weight.

The magnetic material powder preferably has a number average primary diameter of 0.1-0.5 μm. The number average primary size is an arithmetic mean value obtained via measurement of diameters in the Feret direction of 100 magnetic material powder particles employing the electron microscope photograph magnified by 10,000 times.

Further, for the purpose of adjusting magnetic properties and so forth, nonmagnetic metal oxide powder in which nonmagnetic metals such as Mg, Al, Si, Ca, Sc, Ti, V, Cr, Mn, Fe, Co, Ni, Cu, Zn, Sr, Y, Zr, Nb, Mo, Cd, Sn, Ba, Pb and so forth are used singly or in combination with a plurality of kinds is usable with the above-described magnetic material powder. Specific examples of the nonmagnetic metal oxide include $Al_2O_2$, $SiO_2$, CaO and $TiO_2$, $V_2O_5$, $CrO_2$, $MnO_2$, $Fe_2O_3$, CoO, NiO, CuO, ZnO, SrO, $Y_2O_3$, $ZrO_2$ and so forth. The nonmagnetic metal oxide powder preferably has a number average primary particle diameter of 0.1-1.0 μm. The nonmagnetic metal oxide powder in a specific resin dispersion type carrier has a content of 10-60% by weight, and more preferably has a content of 20-40% by weight.

From a viewpoint of improving lipophilicity and hydrophobicity, the surface of the magnetic material powder may be subjected to a lipophilization process with a lipophilization treatment agent such as each of various kinds of coupling agents, higher fatty acids and so forth. The magnetic material powder. The lipophilization treatment agent preferably has an addition amount of 0.1-10 parts by weight, and more preferably has an addition amount of 0.2-6 parts by weight with respect to 100 parts by weight of the magnetic material powder.

[Method of Manufacturing Carrier]

Such the specific resin dispersion type carrier can be prepared via a so-called polymerization method, for example. The specific resin dispersion type carrier produced by the polymerization method has shape of a nearly true sphere, so that contamination of the carrier is inhibited and evenness of the surface is obtained by preparing the specific resin dispersion type carrier by the polymerization method, whereby high charge providing ability can be obtained. In addition, the shape can be easily controlled during preparation.

Specifically, for example, a phenol type, an aldehyde type and magnetic material powder as the raw material monomer are added into an aqueous medium containing a dispersion stabilizer such as colloidal tricalcium phosphate, magnesium hydroxide, hydrophilic silica or the like, and dissolved or dispersed to obtain the phenol formaldehyde resin constituting a binder resin by conducting a polymerization treatment in the presence of a basic catalyst (addition-condensation reaction).

Examples of the basic catalyst include aqueous ammonia, hexamethylenetetramine, and alkylamines such as dimethylamine, diethyltriamine, polyethylene imine and so forth. The basic catalyst is preferably added in an amount of 0.02-0.3 mol, with respect to 1 mol of the phenol type.

Examples of the phenol type include compounds having a phenolic hydroxyl group, such as an alkylphenol type, such as phenol, m-cresol, p-tert-butyl phenol, o-propyl phenol, resorcinol, bisphenol A or the like; and a halogenated phenol type in which a part or all of a benzene nucleus or an alkyl group is substituted by a chlorine atom or a bromine atom, but phenol is specifically preferable since high particle shape ability can be obtained.

Examples of the aldehyde type include formaldehyde and furfural as either formalin or paraformaldehyde, but formaldehyde is preferable.

In the present invention, the specific resin dispersion carrier may be one coated on the surface thereof by a suitable resin selected for suiting the charging amount of the toner to obtain the optimum charging property and charging amount, and high durability. When the carrier particle is coated by the coating resin, the amount of the coating resin is preferably 0.1-10 by weight, and more preferably 0.3-5% by weight, with respect to the carrier particles as the core particles. Further, coating with a coating resin should be controlled by adjusting the coated amount and the coating state in such a way that shape coefficients of the resulting carrier SF-1 and SF-2 are each made to the foregoing values, respectively. In addition, the most preferable method to fall SF-1 and SF-2 within the value range specified in the present invention is to form the carrier via a polymerization method.

[Coating Resin]

A thermoplastic or thermosetting insulating resin is suitably used as the coating resin. Specific examples of the thermoplastic insulating resin include an acrylic resin such as polystyrene, polymethyl methacrylate, a styrene-acrylic acid copolymer or the like; a styrene-butadiene copolymer, a styrene-vinyl acetate copolymer, vinyl chloride, vinyl acetate, a polyvinylidene fluoride resin, a fluorocarbon resin, a perfluorocarbon resin, a solvent-soluble perfluorocarbon resin, polyvinyl alcohol, polyvinyl acetal, polyvinyl pyrrolidone, a petroleum resin, a cellulose derivative such as cellulose, cellulose acetate, cellulose nitrate, methyl cellulose, hydroxymethyl cellulose, hydroxypropyl cellulose or the like; a novolac resin, low molecular weight polyethylene, an aromatic polyester resin such as a saturated alkyl polyester resin, polyethylene terephthalate, polybutylene terephthalate, polyallylate or the like; a polyamide resin, a polyacetal resin, a polycarbonate resin, a polyether sulfone resin, a polysulfone resin, a polyphenylene sulfide resin, a polyether ketone resin and so forth. Examples of the thermosetting insulating resin include a phenol resin, a modified phenol resin, a maleic resin, an alkyd resin, an epoxy resin and an acrylic resin. Specific examples thereof include unsaturated polyester obtained via polycondensation of maleic anhydride-terephthalic acid-polyhydric alcohol, a urea resin, a melamine resin, a urea-melamine resin, a xylene resin, a toluene resin, a guanamine resin, a melamine-guanidine resin, an acetoguanamine resin, a glyptal resin, a furan resin, a silicone resin, polyimide, a polyamidoimide resin, a polyetherimide resin, a polyurethane resin and so forth. These coating resins may be used singly or in combination with at least two kinds. Further, A coated resin may be allowed to be used by mixing a hardener or the like in a thermoplastic insulating resin for curing.

As the method of coating such the coating resin employing specific resin dispersion type carrier particles as the core particle, there are a method in which a coating solution is prepared by dissolving or dispersing the coating resin in an organic solvent and the solution is coated on the carrier particle, and a method in which powder of the coating resin and the carrier particles are mixed to attach the resin onto the carrier particles.

The carrier of the present invention constituting a two-component developer of the present invention is composed of carrier particles having a shape coefficient SF-1 of 10-1.2, and a shape coefficient SF-2 of 1.1-2.5. Shape coefficient SF-1 means an index indicating a spherical degree, and SF-1=1 when the particle is truly sphere. Further, shape coefficient SF-2 means an index indicating a degree of fine irregularity of the carrier particle surface, and SP-2=1 when the surface is smooth with no irregularity.

[Shape Coefficient of Carrier]

Shape coefficients SF-1 and SF-2 can be determined as described below. That is, first, as the advance preparation, a two-component developer and a small amount of a neutral detergent are charged in a beaker; and left standing for a while, the supernatant solution is removed while putting a magnet on the bottom of the beaker. Further, the toner and the neutral detergent are removed by getting rid of the supernatant solution after further adding pure water to separate the carrier only, and the resulting is dried at 40° C. to obtain the carrier alone. Next, as to the carrier separated from the two-component developer via the advance preparation, photographs of 100 particles of the carrier are randomly taken at a magnification of 150 times by a scanning electron microscope, photographic images taken by a scanner are analyzed with an image processing analyzer "LUZEX AP" manufactured by Nireco Corporation, and the measurement is completed by determining the mean value of shape coefficients derived from the following formulae (SF-1) and (SF-2).

$$SF\text{-}1=\{(\mathrm{MXLNG})^2/(\mathrm{AREA})\}\times(\pi/4) \quad \text{Formula (SF-1)}$$

$$SF\text{-}2=\{(\mathrm{PERI})^2/(\mathrm{AREA})\}\times(1/4\pi) \quad \text{Formula (SF-2)}$$

In the above Formulas (SF-1) and (SF-2), MXLNG represents the largest diameter of the carrier particle, AREA represents the projection area of the carrier particle, and PERI is the circumferential length of the carrier particle. Herein, the largest diameter means the width of the carrier particle to maximize the separation distance of two parallel lines when sandwiching the image projected on the plane of the carrier particle by the two parallel lines.

[Carrier Particle Diameter]

The resin dispersion type carrier constituting a two-component developer of the present invention has a volume-based median particle diameter of 10-100 μm, and preferably has a volume-based median particle diameter of 15-80 μm. The volume-based median particle diameter of the specific resin dispersion type carrier can be measured by a laser diffraction type particle size distribution measuring apparatus equipped with a wet disperser "HELOS", manufactured by SYMPATEC Corp.

When the specific resin dispersion type carrier has a volume-based median particle diameter of less than 10 μm, since a presence ratio of particles in carrier particle distribution is increased, and thereby, the carrier particle exhibits lowered magnetization per carrier particle, the carrier particle is transferred into a development sleeve in a developing device, and it can be easily developed onto a photoreceptor. Further, when the specific resin dispersion type carrier has a volume-based median particle diameter exceeding 100 μm, since the specific surface area of the carrier particle becomes small, and thereby, the toner holding force becomes weak, toner scattering is generated. Also in the case of full color having a lot of solid portions, deteriorated reproduction at the solid portions is not specifically preferred.

[Magnetization of Carrier]

The specific resin dispersion type carrier is preferably has a magnetization of 20-300 emu/cm$^3$ in a magnetic field of 1 kOe.

[Carrier Resistance]

Further, the specific resin dispersion type carrier has a slightly low resistance of $10^9$-$10^{14}$ Ωcm, preferably has a slightly low resistance of $10^{10}$-$10^{12}$ Ωcm. In the case of a resistance of less than $10^9$ Ωcm, collection of undeveloped toner in a developing device is increased, and it is effective to inhibit formation of a so-called developing ghost, but charge providing ability to toner is low, and the toner can not be sufficiently charged, whereby fog tends to be generated on formed images. On the other hand, in the case of a resistance exceeding $10^{14}$ Ωcm, the toner tends to be excessively charged. The resistance of the specific resin dispersion type carrier is obtained such that after carrier is left for one day night at normal temperature and normal humidity environment (20° C. and 50% RH), the carrier is put into a cylinder having a bottom surface of 1 cm$^2$ and made of a resin, the upper and lower portions of the cylinder are sandwiched by electrodes, a load of 1 Kg is applied onto the cylinder, a voltage of 1000V is applied between the electrodes, and an electric current is measured for 30 seconds, whereby the resistance is obtained via measurement of volume specific resistance.

The mixing ratio of the toner and the carrier in a two-component developer of the present invention is determined to obtain a toner concentration of 3-20% by weight, and preferably a toner concentration of 4-15% by weight.

[Image Forming Method]

A two-component developer as described above is usable in commonly known various image forming methods in the electrophotographic technique, resulting in preferable effects, but the two-component developer rarely deteriorate, preferable effects can be obtained in the case of application to full color image formation because of developing stably conducted for a long duration. In this case, usable is any of image forming methods such as a four cycle system image forming method employing four kinds of color developing devices for yellow, magenta, cyan and black, and a single electrostatic latent image carrier; a tandem system image forming method providing an image forming unit possessing a color developing device and an electrostatic latent image carrier individually for each color, and so forth. When the two-component developer of the present invention is used for full color image formation, developing is stably conducted for a long duration, whereby color stability of the resulting color image can be maintained for a long duration. Further, since the two-component developer of the present invention is difficult to receive stress, suitably usable is a so-called toner recycling system image forming method by which toner remaining on an electrostatic latent image carrier is collected by a cleaning device, and recycled by getting it back to a developing device.

[Image Support]

The image support used in an image forming method employing a two-component developer of the present invention is a support holding a toner image, and specific examples of various types of materials include plain papers from thin paper to thick paper; fine-quality paper; printing paper such as art paper and coated paper; commercially available Japanese paper and postcard paper; plastic film for OHP; and cloth, but these are not limited thereto.

According to the two-component developer as described above, the carrier is a resin dispersion type carrier having a specific shape (hereinafter, referred to also as a specific resin dispersion type carrier), and it exhibits high durability originated from high toughness produced by a high crosslinking structure in a phenol formaldehyde resin. Since the toner contains specific external particles, and the specific external particles are made of a titanic acid compound and iron in the specific content range, generation of excessive electrification is suppressed, and thereby, charge buildup of the foregoing carrier is inhibited. Accordingly, since stable developability can be obtained for a long duration, excellent quality image in sufficient image density can be stably formed for a long duration. Further, since the specific external additive particles exhibit sufficient electrification, excellent quality image can also be stably formed for a long duration. Further, according to such the two-component developer, since electrification environment stability of the toner is obtained, stable images not depending on the environment condition can be formed.

The reason why excessive electrification is suppressed while the specific external additive particles contained in the toner exhibit sufficient electrification, and thereby, the charge buildup of the carrier is inhibited is presumably that the specific external additive particles serve as the effective charging site in the toner particle when the titanic acid compound is a high dielectric, and contains a small amount of iron, and excessive electrification can be controlled by being able to appropriately leak an excessive amount of the charge while obtaining an excellent charge rising property and excellent charge-holding ability for the toner via the foregoing.

Embodiments of the present invention have been specifically described above, but the embodiments of the present invention are not limited to the above-described examples, and various changes may be added.

EXAMPLE

Next, examples of the present invention will now be described, but the present invention is not limited thereto.

Carrier Preparation Example 1

To magnetite ($FeO.Fe_2O_3$) powder having a number average primary particle diameter of 0.24 μm and $\alpha$-$Fe_2O_3$ powder having a number average particle diameter of 0.60 μm, 5.5% by weight of a silane coupling agent {3-(2-aminoethylaminopropyl)dimethoxysilane} was each added, while stirring at high speed at 100° C. in a stirring vessel, and metal oxide fine powder was each subjected to a lypophilization treatment to prepare lipophilic magnetite powder A and lipophilic $\alpha$-iron oxide powder A. Next, composition (1) composed of 60 parts by weight of the above-described lipophilic magnetite powder A, 40 parts by weight of $\alpha$-iron oxide powder A having been subjected to a lypophilization treatment, 10 parts by weight of phenol and 6 parts by weight of a formaldehyde solution containing 40% by weight of formaldehyde, 10% by weight of methanol and 50% by weight of water was added into an aqueous medium containing 28% by weight of an aqueous $NH_4OH$ solution in a flask, the resulting was heated up to 85° C. spending 40 minutes while stirring for mixing to conduct a thermosetting reaction for 3 hours while maintaining at this temperatures and was subsequently cooled to 30° C. Water was further added, the supernatant solution was removed, a remaining precipitate was washed with water, the resulting was dried by air, and subsequently, further dried under reduced pressure of 5 mmHg at 60° C. to obtain carrier particle [a]. This carrier particle [a] was employed as the core particle, toluene was employed as a solvent, a coating solution containing 10% by weight of a silicone resin material was prepared, the solvent was vaporized while continuously applying shear stress to this coating solution, and the resulting was coated on the core particle surface so as to give a coat resin amount of 1.0% by weight. Next, the coated layer was cured at 200° C. for one hour, and pulverized, and then classified by a sieve of 200 meshes to obtain carrier (a) as a specific resin dispersion type carrier having a silicone resin coated on the surface.

This carrier [a] had a volume-based median diameter of 34 μm, and also has a shape coefficient SF-1 of 1.04 and a shape coefficient SF-2 of 1.51. Further, it had a magnetization of 129 emu/cm$^3$ at 1 kOe, and also had a resistance of $3\times10^{11}$ Ωcm. Herein, the volume-based median diameter was measured by a laser diffraction type particle size distribution measuring apparatus equipped with a wet disperser "HEROS", manufactured by SYMPATEC Corp., and shape coefficients SF-1 and SF-2 were measured as described before. Further, the magnetization was measured by a vibration magnetic field type automatic magnetic property recording apparatus "BHV-30", manufactured by Riken Denshi Co., Ltd.

Carrier Preparation Example 2

Carrier particle [b] was obtained similarly to the case of carrier preparation example 1, except that composition (1) was replaced by composition (2) composed of 100 parts by weight of the above-described magnetite powder having been subjected to a lypophilization treatment, 10 parts by weight of phenol, and 6 parts by weight of a formaldehyde solution containing 40% by weight of formaldehyde, 10% by weight of methanol and 50% by weight of water, and carrier (b) as a specific resin dispersion type carrier was obtained similarly to the case of carrier preparation example 1, except that this carrier particle [b] was used as the core particle so as to give a coat resin amount of 1.5% by weight. This carrier (b) had a volume-based median particle diameter of 39 μm, a shape coefficient SF-1 of 1.10, and $\alpha$-shape coefficient SF-2 of 1.15. Further, it had a magnetization of 218 emu/cm$^3$ at 1 kOe, and had a resistance of $6\times10^{11}$ Ωcm.

Carrier Preparation Example 3

Carrier particle [c] was obtained similarly to the case of carrier preparation example 2, except that 4.5% by weight of a silane coupling agent {3-(2-aminoethylaminopropyl) dimethoxysilane} was added into magnetite ($FeO.Fe_2O_3$) powder having a number average primary particle diameter of 0.25 μm as lipophilic magnetite powder, the resulting was mixed in a stirring vessel at 100° C. while stirring at high speed, and lipophilic magnetite powder B obtained via a lipophilization treatment of metal oxide particles was used, and carrier (c) as a specific resin dispersion type carrier was obtained similarly to the case of carrier preparation example 1, except that this carrier particle [c] was used as the core particle. This carrier (c) had a volume-based median particle diameter of 41 μm, a shape coefficient SF-1 of 1.04, and a shape coefficient SF-2 of 1.95. Further, it had a magnetization of 220 emu/cm$^3$ at 1 kOe, and had a resistance of $8\times10^{11}$ Ωcm.

Comparative Carrier Preparation Example 1

Into a radical polymerizable monomer composition composed of 8 parts by weight of styrene, 2 parts by weight of 2-ethylhexyl acrylate, 1 part by weight of divinylbenzene, dispersed were 60 parts by weight of lipophilic magnetite powder A and 40 parts by weight of lipophilic $\alpha$-iron oxide powder, and 0.3 parts by weight of a radical polymerization initiator (lauroyl peroxide) was subsequently added to prepare a carrier forming solution. On the other hand, 600 parts by weight of deionized water and 500 parts by weight of a 0.1 moles/L $Na_3PO_4$ aqueous solution were charged in a 2 L four-mouth flask equipped with a high speed stirrer TK type Homomixer, manufactured by Tokushu Kika Kogyo Co., Ltd., and a baffle plate, and the resulting was heated to 65° C., and then 70 parts by weight of a 1.0 mol/L $CaCl_2$ aqueous solution was gradually added while stirring at 14,000 rpm to prepare an aqueous medium containing considerably insoluble dispersion $Ca_3(PO_4)_2$ stabilizer fine particles. Next, the carrier forming liquid was added into the aqueous medium and oil droplets of the carrier forming liquid were formed in the aqueous medium by stirring at 14,000 rpm with a high speed stirrer KT type Homomixer, manufactured by Tokushu Kika Kogyo Co., Ltd. Subsequently, the stirrer was replaced by propeller type stirring blades, and the system was heated to 75° C. to conduct polymerization reaction for 8 hours. Then the system was cooled and a hydrochloric acid was added to remove the dispersion stabilizer. After the foregoing, carrier particle [d] was obtained via filtration, and washing and drying. Carrier (d) as a comparative resin dispersion type carrier was obtained similarly to the case of carrier preparation example 1, except that this carrier particle [d] was used as the core particle. This comparative carrier (d) had a volume-based median particle diameter of 41 μm, a shape coefficient SF-1 of 1.05, and a shape coefficient SF-2 of 1.31. Further, it had a magnetization of 129 emu/cm$^3$ at 1 kOe, and had a resistance of $9\times10^{11}$ Ωcm.

Comparative Carrier Preparation Example 2

Obtained was comparative carrier (e) in which a silicone resin was coated on the surface of Li-ferrite particle having a shape coefficient SF-1 of 1.3 and a shape coefficient SF-2 of 2.52, which was prepared by a sintering method. This comparative carrier (e) had a volume based median particle diameter of 45 μm, and also had a resistance of $6\times10^{9}$ Ωcm. In addition, SF-1 and SF-2 of the carrier after silicone coating remain unchanged to be 1.3 and 2.52, respectively.

Comparative Carrier Preparation Example 3

Into 100 parts by weight of a polyester resin having a softening point of 150° C., added was 900 parts by weight of magnetite powder having a number average primary particle diameter of 0.24 μm; and the resulting was melted and kneaded by a biaxial extruder. Then, the resulting was crushed by a mechanical crushing machine to obtain a crushed powder having a volume-based median particle diameter of 38 μm. This was subjected to a spheronization treatment employing an instantaneous heat treatment apparatus for heating at 180° C. for 5 seconds, and next, a silicone resin was coated on the surface similarly to comparative carrier preparation example 1 (Example 1) to obtain comparative carrier (f). This comparative carrier (f) had a volume-based median particle diameter of 39 μm, a shape coefficient SF-1 of 1.02 and a shape coefficient SF-2 of 1.04. Further, it had a magnetization of 218 emu/cm$^3$ at 1 kOe, and had a resistance of $7\times10^{12}$ Ωcm.

External Additive Particle Preparation Example 1

After conducting a desulphurization treatment by adding an aqueous 4.0 mol/L sodium hydroxide solution into a metatitanic acid dispersion to adjust a pH to 9.0, a neutralization treatment was conducted by adding an aqueous 6.0 mol/L hydrochloric acid solution to adjust the pH to 5.5. After that, a metatitanic acid cake was obtained via filtration of the metatitanic acid dispersion and washing. A metatitanic acid dispersion having a concentration of 1.25 mol/L in terms of titanium oxide $TiO_2$ was prepared by adding water to the resulting cake, and an aqueous 6.0 moles/L hydrochloric acid solution was added into the meta titanic acid dispersion to adjust the pH to 1.2. Then, temperature of this metatitanic acid dispersion was adjusted to 35° C. while stirring at this temperature for 60 minutes to conduct deflocculation treatment [I] for the metatitanic acid dispersion. From the titanic acid dispersion having been subjected to this deflocculation treatment [I], an amount corresponding to 0.156 moles in terms of $TiO_2$ as the metatitanic acid amount was taken out, and charged in a reaction vessel. Continuously, an aqueous calcium carbonate solution was added in such a way that a mole ratio of calcium carbonate $CaCO_3$ to titanium dioxide $TiO_2$ became 1.15 ($CaCO_3/TiO_2$=1.15/1), and an aqueous ferric chloride solution was also added in such a way that a mole ratio of ferric chloride $FeCl_3$ to titanium dioxide $TiO_2$ became 0.009 ($FeCl_3/TiO_2$=0.009/1). After this, the reaction system was adjusted so as to give a titanium dioxide ($TiO_2$) concentration of 0.156 mol/L, and left standing for 20 minutes while flowing nitrogen gas to introduce nitrogen gas into a reaction vessel. After the reaction system was heated to 90° C., an aqueous sodium hydroxide solution was added spending 24 hours until the pH reaches 8.0, and the system was continuously stirred at 90° C. for one hour to terminate the reaction. After completion of the reaction, the reaction system was cooled to 40° C., the supernatant solution was removed under the nitrogen atmosphere, and 2500 parts by weight of pure water was added to conduct decantation operations twice for washing. Subsequently, the reaction system was filtrated with a Nutsche filter to obtain a cake. The resulting cake was heated under the ambient temperature at 110° C. for 8 hours, and dried to obtain calcium titanate compound. The resulting calcium titanate compound was placed in an alumina crucible, followed by dehydration and calcination at 930° C. After this, the calcium titanate compound having been subjected to dehydration, calcination was charged in water, and a wet crushing treatment was conducted employing a sand grinder to obtain a calcium titanate particle dispersion. Then, an aqueous 6.0 mol/L hydrochloric acid solution was added to adjust the pH to 2.0, and excessive calcium carbonate was removed to obtain calcium titanate particle [1].

Into 100 parts by weight of calcium titanate particle [1] in terms of a solid content, added was 0.7 parts by weight of silicone oil emulsion (dimethylpolysiloxane based emulsion) "SM7036EX", manufactured by Toray Dow Corning Silicone Co., Ltd., while stirring for 30 minutes to conduct a wet hydrophobilization treatment for calcium titanate particles. Subsequently, the pH was adjusted to 6.5 by adding an aqueous 4.0 mol/L sodium hydroxide solution, followed by filtration and washing, and then the system was dried at 150° C. Further, pulverization treatment [II] was conducted for 60 minutes with a mechanical crusher to obtain external additive particle [I] composed of hydrophobic calcium titanate particles containing iron atoms.

This external additive particle [1] had an iron content of 102 ppm, a number average primary particle diameter of 207 nm, a sd value of 111 nm as a quartile deviation value of a number average primary particle diameter, and a BET specific surface area of 16.0 m$^2$/g. In addition, the iron content, number average primary particle diameter, and the BET specific surface area are measured by the above-described method, and the sd value is calculated in accordance with the above-described calculation method. The same method is also used for the following.

External Additive Particle Preparation Examples 2-7

External additive particles [2]-[7] composed of hydrophobic calcium titanate particles were prepared similarly to the cage of External additive particle preparation example 1, except that an aqueous ferric chloride ($FeCl_3$) solution was added so as to give a molar ratio of ferric chloride ($FeCl_3$) to titanium dioxide ($TiO_2$) in external additive particle preparation example 1 as shown in Table 1. In addition, external additive particles [4]-[7] are for comparative samples.

External Additive Particle Preparation Example 8

External additive particle [8] composed of hydrophobic calcium titanate particles was prepared similarly to the case of External additive particle preparation example 1, except that 60 minutes for deflocculation treatment [I] were replaced by 90 minutes, and 60 minutes for pulverization treatment [II] were replaced by 90 minutes in External additive particle preparation example 1.

External Additive Particle Preparation Example 9

External additive particle [9] composed of hydrophobic calcium titanate particles was prepared similarly to the case of External additive particle preparation example 1, except that 60 minutes for deflocculation treatment [I] were, replaced by 90 minutes in External additive particle preparation example 1.

External Additive Particle Preparation Example 10

External additive particle [10] composed of hydrophobic calcium titanate particles was prepared similarly to the case of External additive particle preparation example 1, except that 60 minutes for deflocculation treatment [I] were replaced by 50 minutes, and 60 minutes for pulverization treatment [II] were replaced by 45 minutes in External additive particle preparation example 1.

External Additive Particle Preparation Example 11

External additive particle [11] composed of hydrophobic calcium titanate particles was prepared similarly to the case of External additive particle preparation example 1, except that 60 minutes for deflocculation treatment [I] were replaced by 20 minutes, and 60 minutes for pulverization treatment [II] were replaced by 30 minutes in External additive particle preparation example 1.

External Additive Particle Preparation Example 12

External additive particle [12] composed of hydrophobic calcium titanate particles was prepared similarly to the case of External additive particle preparation example 1, except that 60 minutes for deflocculation treatment [I] were replaced by 15 minutes, and 60 minutes for pulverization treatment [II] were replaced by 20 minutes in External additive particle preparation example 1.

External Additive Particle Preparation Example 13

External additive particle [13] composed of hydrophobic strontium titanate particles was prepared similarly to the case of External additive particle preparation example 2, except that calcium carbonate was replaced by strontium carbonate in External additive particle preparation example 2.

External Additive Particle Preparation Example 14

External additive particle [14] composed of hydrophobic strontium titanate particles was prepared similarly to the case of External additive particle preparation example 4, except that calcium carbonate was replaced by strontium carbonate in External additive particle preparation example 4.

External Additive Particle Preparation Example 15

External additive particle [15] composed of hydrophobic magnesium titanate particles was prepared similarly to the case of External additive particle preparation example 2, except that calcium carbonate was replaced by magnesium carbonate in External additive particle preparation example 2.

External Additive Particle Preparation Example 16

External additive particle [16] composed of hydrophobic magnesium titanate particles was prepared similarly to the case of External additive particle preparation example 4, except that calcium carbonate was replaced by magnesium carbonate in External additive particle preparation example 4.

External Additive Particle Preparation Example 17

External additive particle [17] composed of hydrophobic barium titanate particles was prepared similarly to the case of External additive particle preparation example 2, except that calcium carbonate was replaced by barium carbonate in External additive particle preparation example 2.

External Additive Particle Preparation Example 18

External additive particle [18] composed of hydrophobic barium titanate particles was prepared similarly to the case of External additive particle preparation example 4, except that calcium carbonate was replaced by barium carbonate in External additive particle preparation example 4.

The iron content, number average primary particle diameter, sd value and BET specific surface area of external additive particles [1]-[18] are shown in Table 1.

TABLE 1

| | | Condition of iron atom | | Properties of titanic acid compound | | |
|---|---|---|---|---|---|---|
| *1 | Metal atom kind | Molar ratio of ferric chloride to titanium dioxide | Iron content (ppm) | Number average primary particle diameter (nm) | Sd value (nm) | BET Specific surface area ($m^2/g$) |
| 1 | Ca | 0.009 | 102 | 207 | 111 | 16.0 |
| 2 | Ca | 0.030 | 400 | 205 | 110 | 16.3 |
| 3 | Ca | 0.076 | 900 | 200 | 100 | 16.0 |
| 4 | Ca | 0 | 0 | 207 | 111 | 16.3 |
| 5 | Ca | 0.006 | 80 | 210 | 118 | 17.1 |
| 6 | Ca | 0.075 | 1010 | 207 | 118 | 16.5 |
| 7 | Ca | 0.086 | 1102 | 203 | 121 | 16.1 |
| 8 | Ca | 0.03 | 440 | 35 | 88 | 35.5 |
| 9 | Ca | 0.03 | 420 | 50 | 250 | 23.8 |
| 10 | Ca | 0.03 | 400 | 400 | 202 | 9.8 |
| 11 | Ca | 0.03 | 410 | 2000 | 330 | 5.0 |
| 12 | Ca | 0.03 | 430 | 2800 | 400 | 3.5 |
| 13 | Sr | 0.03 | 450 | 240 | 222 | 3.2 |
| 14 | Sr | 0 | 0 | 239 | 220 | 3.6 |
| 15 | Mg | 0.03 | 440 | 226 | 139 | 18.1 |
| 16 | Mg | 0 | 0 | 225 | 140 | 18.4 |
| 17 | Ba | 0.03 | 500 | 95 | 90 | 19.6 |
| 18 | Ba | 0 | 0 | 97 | 91 | 19.7 |

*1: External additive particle No.

Colored Particle Preparation Example A (A1) Preparation of Resin Particle Dispersion (A1-1) Preparation of Resin Particle 1H In 3010 parts by weight of deionized water, dissolved were 7.08 parts by weight of sodium laurylsulfate in a reaction vessel fitted with a stirrer, a thermal sensor, a cooling pipe and a nitrogen introducing device to prepare a surfactant solution. The temperature inside the reaction vessel was raised to 80° C. while stirring this surfactant solution at a stirring rate of 230 rpm under the nitrogen flow. Next, a polymerization initiator solution in which 9.2 parts by weight of potassium persulfate (KPS) as a polymerization initiator were dissolved in 200 parts by weight of deionized water was charged in the surfactant solution, and the temperature inside the reaction vessel was set to 75° C. Subsequently, mixed solution [a1] prepared by mixing the following compounds was dropped spending one hour.

| | |
|---|---|
| Styrene | 69.4 parts by weight |
| n-butylacrylate | 28.3 parts by weight |
| Methacrylic acid | 2.3 parts by weight |

Further, polymerization was carried out while stirring at 75° C. for 2 hours to prepare resin particle dispersion [1H] obtained by dispersing resin particle 1H.

(A1-2) Preparation of Resin Particle 1HM

The following compounds were charged in a flask fitted with a stirrer.

| | |
|---|---|
| Styrene | 97.1 parts by weight |
| n-butyl acrylate | 39.7 parts by weight |
| Methacrylic acid | 3.22 parts by weight |
| n-octyl-3-mercaptopropionate | 5.6 parts by weight |

Further, 98.0 parts by weight of pentaerythrytol tetrabehenate were added and heated to 90° C. to prepare mixed solution [a2] obtained by mixing the above-described compounds. On the other hand, a surfactant solution in which 1.6 parts by weight of sodium laurylsulfate were dissolved in 2700 parts by weight of deionized water was prepared in a reaction vessel fitted with a stirrer, a thermal sensor, a cooling pipe and a nitrogen introducing device, and heated to 98° C. to charge mixed solution [a2] after adding 28 parts by weight of above-described resin particle dispersion [1H] in terms of a solid content into this surfactant solution. Further, the resulting was mixed and dispersed for 8 hours by a mechanical dispersing machine equipped with a circulation path "CLEARMIX", manufactured by M-Technique Co., Ltd., to prepare a dispersion (emulsion). Next, 750 parts by weight of deionized water and an initiator solution in which 5.1 parts by weight of potassium persulfate (KPS) were dissolved in 240 parts by weight of deionized water were added into this emulsion, and polymerization was carried out by stirring this reaction system at 98° C. for 12 hours to prepare resin particle dispersion [1HM] obtained by dispersing resin particle 1M having a composite structure in which a resin was coated on the surface of resin particle 1H. (A1-3) Preparation of resin particle 1HM.

An initiator solution in which 7.4 parts by weight of potassium persulfate (KPS) were dissolved in 200 parts by weight of deionized water was added into foregoing resin particle [1HM], and temperature was adjusted to 80° C. Subsequently, Mixed solution [a3] containing the following compounds was dropped spending one hour.

| | |
|---|---|
| Styrene | 277 parts by weight |
| n-butylacrylate | 113 parts by weight |
| Methacrylic acid | 9.21 parts by weight |
| n-octyl-mercaptopropionate | 10.4 parts by weight |

After completion of this dropping, the system was heated for 2 hours maintaining the temperature at 80° C. while stirring to conduct polymerization, and then, the reaction system was cooled to 28° C. to prepare resin particle dispersion [1HML] obtained by dispersing resin particle 1HML having a composite structure in which a resin was coated on the surface of resin particle 1HM.

(A2) Preparation of Colorant Particle Dispersion

Into 1,600 parts by weight of deionized water, charged were 90 parts by weight of anionic surfactant sodium laurylsulfate to prepare a surfactant solution while stirring. While stirring the system, 400 parts by weight of carbon black "Regal 330R" produced by Cabot Corp. were gradually added, and dispersing was conducted employing a mechanical dispersing device "CLEAMIX", manufactured by M-Technique Co., Ltd. until the particle diameter of carbon black reached 200 nm to prepare colorant particle dispersion [Bk].

(A3) Preparation of Colored Particle A

Those described below were charged in a reaction vessel fitted with a stirrer, a thermal sensor, a cooling pipe and a nitrogen introducing device,

| | |
|---|---|
| Resin particle dispersion [1HML] | 200 parts by weight |
| Deionized water | 3,000 parts by weight |
| Colorant particle dispersion [Bk] | 71 parts by weight |

temperature inside the reaction vessel was set to 30° C. and the pH was adjusted to 10.6 by further adding 5 mol/L of an aqueous sodium hydroxide solution. After this, an aqueous solution in which 52.6 parts by weight of magnesium chloride hexahydrate were dissolved in 72 parts by weight of deionized water was added into the system spending 10 minutes while stirring at 30° C., and then the reaction system was left standing for 3 minutes. Next, the temperature of the reaction system was raised to 75° C. spending 60 minutes to initiate coagulation of particles. The coagulation was continued while measuring the diameter of coagulated particles employing "Multisizer 3", manufactured by Beckman Coulter Inc., and particle growth was stopped by adding an aqueous solution in which 115 parts by weight of sodium chloride were dissolved in 700 parts by weight of deionized water at a time when the particle diameter of coagulated particles became a volume-based median diameter of 6.5 μm. Further, as to a ripening treatment, the reaction system was set to 90° C., and a heat treatment while stirring was conducted for 6 hours continuously to fuse particles. The reaction system was subsequently cooled to 30° C., the pH was adjusted to 2.0 by adding a hydrochloric acid. Then, stirring was terminated, the solid-liquid separation of particles was conducted, and washing was repeatedly conducted with deionized water at 45° C. Then, colored particle [A] was prepared via hot-air drying at 45° C. Colored particle [A] had an acid value of 15 mg·KOH/g measured in accordance with JIS 0070 1992.

Colored Particle Preparation Example B (B1) Preparation of Resin Particle Dispersion (B1-1) Preparation of Resin Particle 2H Resin particle dispersion [2H] obtained by dispersing resin particle 2H was prepared similarly to the foregoing (A1-1) preparation of resin particle 1H, except that mixed solution [a1] was replaced by mixed solution [b1] obtained by mixing the following compounds in a process of the foregoing (A1-1) preparation of resin particle 1H.

| | |
|---|---|
| Styrene | 70.3 parts by weight |
| n-butylacrylate | 28.7 parts by weight |
| Methacrylic acid | 1.0 part by weight |

(B1-2) Preparation of Resin Particle 2HM

Resin particle dispersion [2HM] obtained by dispersing resin particle 2HM was prepared similarly to the foregoing (A1-2) preparation of resin particle 1HM, except that mixed solution [a2] was replaced by mixed solution [b2] obtained by mixing the following compounds in a process of the foregoing (A1-2) preparation of resin particle 1HM.

| | |
|---|---|
| Styrene | 98.3 parts by weight |
| n-butylacrylate | 40.2 parts by weight |
| Methacrylic acid | 1.51 parts by weight |
| n-octyl-3-mercaptopropionate | 5.6 parts by weight |
| Pentaerythrytol tetrabehenate | 98 parts by weight |

(B1-3) Preparation of Resin Particle 2HML

Resin particle dispersion [2HML] obtained by dispersing resin particle 2HML was prepared similarly to the foregoing (A1-3) preparation of resin particle 1HML, except that mixed solution [a3] was replaced by mixed solution [b3] obtained by mixing the following compounds in a process of the foregoing (A1-3) preparation of resin particle 1HML.

| | |
|---|---|
| Styrene | 283 parts by weight |
| n-butylacrylate | 115 parts by weight |
| Methacrylic acid | 4.3 parts by weight |
| n-octyl-3-mercaptopropionate | 10.4 parts by weight |

(B3) Preparation of Colored Particle B

Colored particle [B] was prepared similarly to the forgoing (A3) preparation of colored particle A, except that resin particle dispersion [1HML] was replaced by resin particle dispersion [2HML] in a process of the forgoing (A3) preparation of colored particle A. Colored particle [B] had an acid value of 7 mg·KOH/g measured in accordance with JIS 0070 1992.

Colored Particle Preparation Example C (C1) Preparation of Resin Particle Dispersion (C1-1) Preparation of Resin Particle 3H Resin particle dispersion [3H] obtained by dispersing resin particle 3H was prepared similarly to the foregoing (A1-1) preparation of resin particle 1H, except that mixed solution [a1] was replaced by mixed solution [c1] obtained by mixing the following compounds in a process of the foregoing (A1-1) preparation of resin particle 1H.

| | |
|---|---|
| Styrene | 74.5 parts by weight |
| n-butylacrylate | 21.6 parts by weight |
| Acrylic acid | 1.93 parts by weight |

(C1-2) Preparation of Resin Particle 3HM

Resin particle dispersion [3HM] obtained by dispersing resin particle 3HM was prepared similarly to the foregoing (A1-2) preparation of resin particle 1HM, except that mixed solution [a2] was replaced by mixed solution [c2] obtained by mixing the following compounds in a process of the foregoing (A1-2) preparation of resin particle 1HM.

| | |
|---|---|
| Styrene | 104 parts by weight |
| n-butylacrylate | 30.2 parts by weight |
| Acrylic acid | 2.7 parts by weight |
| n-octyl-3-mercaptopropionate | 5.6 parts by weight |
| Pentaerythrytol tetrabehenate | 98 parts by weight |

(C1-3) Preparation of Resin Particle 3HML

Resin particle dispersion [3HML] obtained by dispersing resin particle 3HML was prepared similarly to the foregoing (A1-3) preparation of resin particle 1HML, except that mixed solution [a3] was replaced by mixed solution [c3] obtained by mixing the following compounds in a process of the foregoing (A1-3) preparation of resin particle 1HML.

| | |
|---|---|
| Styrene | 306 parts by weight |
| n-butylacrylate | 88.5 parts by weight |
| Acrylic acid | 17.4 parts by weight |
| n-octyl-3-mercaptopropionate | 10.4 parts by weight |

(c3) Preparation of Colored Particle C

Colored particle [c] was prepared similarly to the forgoing (A3) preparation of colored particle A, except that resin particle dispersion [1HML] was replaced by resin particle dispersion [3HML] in a process of the forgoing (A3) preparation of colored particle A. Colored particle [C] had an acid value of 7 mg·KOH/g measured in accordance with JIS 0070 1992.

Colored Particle Preparation Example D1

(D1) Preparation of Resin Particle Dispersion (D1-1) Preparation of Resin Particle 4H Resin particle dispersion [4H] obtained by dispersing resin particle 4H was prepared similarly to the foregoing (A1-1) preparation of resin particle 1H, except that mixed solution [a1] was replaced by mixed solution [d1] obtained by mixing the following compounds in a process of the foregoing (A1-1) Preparation of Resin Particle 1H.

| | |
|---|---|
| Styrene | 70.7 parts by weight |
| n-butylacrylate | 28.9 parts by weight |
| Acrylic acid | 0.386 parts by weight |

(D1-2) Preparation of Resin Particle 4HM

Resin particle dispersion [4HM] obtained by dispersing resin particle 4HM was prepared similarly to the foregoing (A1-2) preparation of resin particle 1HM, except that mixed solution [a2] was replaced by mixed solution [d2] obtained by mixing the following compounds in a process of the foregoing (A1-2) preparation of resin particle 1HM.

| | |
|---|---|
| Styrene | 99 parts by weight |
| n-butylacrylate | 40.4 parts by weight |
| Acrylic acid | 0.54 parts by weight |
| n-octyl-3-mercaptopropionate | 5.6 parts by weight |
| Pentaerythrytol tetrabehenate | 98 parts by weight |

(D1-3) Preparation of Resin Particle 4HML

Resin particle dispersion [4HML] obtained by dispersing resin particle 4HML was prepared similarly to the foregoing (A1-3) preparation of resin particle 1HML, except that mixed solution [a3] was replaced by mixed solution [d3] obtained by mixing the following compounds in a process of the foregoing (A1-3) preparation of resin particle 1HML.

| | |
|---|---|
| Styrene | 281 parts by weight |
| n-butylacrylate | 114.8 parts by weight |
| Acrylic acid | 1.54 parts by weight |
| n-octyl-3-mercaptopropionate | 10.4 parts by weight |

(D3) Preparation of Colored Particle D

Colored particle [D] was prepared similarly to the forgoing (A3) preparation of colored particle A, except that resin particle dispersion [1HML] was replaced by resin particle dispersion [4HML] in a process of the forgoing (A3) preparation of colored particle A. Colored particle [D] had an acid value of 3 mg·KOH/g measured in accordance with JIS 0070 1992.

Colored Particle Preparation Example E (E1) Preparation of Resin Particle Dispersion (E1-1) Preparation of Resin Particle 5H Resin particle dispersion [5H] obtained by dispersing resin particle 5H was prepared similarly to the foregoing (A1-1) preparation of resin particle 1H, except that mixed solution [a1] was replaced by mixed solution [e1] obtained by mixing the following compounds in a process of the foregoing (A1-1) preparation of resin particle 1H.

| | |
|---|---|
| Styrene | 67.8 parts by weight |
| n-butylacrylate | 27.7 parts by weight |
| Methacrylic acid | 4.5 parts by weight |

(E1-2) Preparation of Resin Particle 5HM

Resin particle dispersion [5HM] obtained by dispersing resin particle 5HM was prepared similarly to the foregoing (A1-2) preparation of resin particle 1HM, except that mixed solution [a2] was replaced by mixed solution [e2] obtained by mixing the following compounds in a process of the foregoing (A1-2) preparation of resin particle 1HM.

| | |
|---|---|
| Styrene | 94.1 parts by weight |
| n-butylacrylate | 38.4 parts by weight |
| Methacrylic acid | 7.53 parts by weight |
| n-octyl-3-mercaptopropionate | 5.6 parts by weight |
| Pentaerythrytol tetrabehenate | 98 parts by weight |

(E1-3) Preparation of Resin Particle 5HML

Resin particle dispersion [5HML] obtained by dispersing resin particle 5HML was prepared similarly to the foregoing (A1-3) preparation of resin particle 1HML, except that mixed solution [a3] was replaced by mixed solution [e3] obtained by mixing the following compounds in a process of the foregoing (A1-3) preparation of resin particle 1HML.

| | |
|---|---|
| Styrene | 269 parts by weight |
| n-butylacrylate | 110 parts by weight |
| Methacrylic acid | 21.5 parts by weight |
| n-octyl-3-mercaptopropionate | 10.4 parts by weight |

(E3) Preparation of Colored Particle E

Colored particle [E] was prepared similarly to the forgoing (A3) preparation of colored particle A, except that resin particle dispersion [1HML] was replaced by resin particle dispersion [5HML] in a process of the forgoing (A3) preparation of colored particle A. Colored particle [E] had an acid value of 35 mg·KOH/g measured in accordance with JIS 0070 1992.

Colored Particle Preparation Example YeA-YeE, MaA-MaE, and CyA-CyE

Yellow colored particles [YeA]-[YeE], magenta colored particles [MeA]-[MeE], and cyan colored particles [CeA]-[CeE] were obtained similarly to colored particle preparation examples A-E, except that carbon black as a colorant to be employed was replaced by C.I. pigment yellow 74, C.I. pigment red 122, and C.I. pigment blue 15:3, respectively.

Two parts by weight of external additive particle [1], 1.0 part by weight of hydrophobic silica having a particle diameter of 7 nm and 1.0 part by weight of hydrophobic silica having a particle diameter of 21 nm were added into 100 parts by weight of colored particle [A], and the resulting was stirred at a stirring blade circumferential speed of 35 m/sec for 20 minutes at 30° C. employing a Henschel mixer "FM10B", manufactured by Mitsui Miike Kakou Co., Ltd. Coarse particles were subsequently removed by using a sieve having an opening of 90 μm to prepare Toner [1]. In addition, shape and particle diameter of colored particles were not changed via addition of external additive particles.

Toner Preparation Examples 2-22

Toners [2]-[22] were obtained similarly to toner preparation example 1, except that kinds of colored particles and kinds of external additive particles were changed as shown in Table 2. Among these, each of toners [4]-[7], [14], [16] and [18] is of a comparative example.

Toner Preparation Examples Ye1-Ye22, Ma1-Ma22, and Cy1-Cy22

Toners [Ye1]-[Ye22], toners [Ma1]-[Ma22], and toners [Cy1]-[Cy22] were obtained similarly to toner preparation examples 1-22, except that colored particles [A]-[E] to be employed were replaced by colored particles [YeA]-[YeE], colored particles [Mak]-[MaE] and colored particles [CyA]-[CyE], respectively. Each of combinations is shown in Tables 3-5. Among these, each of toners [Ye4]-[Ye7], [Ye14], [Ye16], [Ye18], [Ma4]-[ma7], [Ma14], [Ma16], [Ma18], [Cy4]-[Cy7], [Cy14], [Cy16], and [Cy18] is of a comparative example.

TABLE 2

| | Colored particle | | External additive particle | | |
|---|---|---|---|---|---|
| Toner No. | No. | Acid value | No. | Iron content (ppm) | Addition amount of toner (parts by weight) |
| 1 | A | 15 | 1 | 102 | 2.0 |
| 2 | A | 15 | 2 | 400 | 2.0 |
| 3 | A | 15 | 3 | 900 | 2.0 |
| 4 | A | 15 | 4 | 0 | 2.0 |
| 5 | A | 15 | 5 | 80 | 2.0 |
| 6 | A | 15 | 6 | 1010 | 2.0 |
| 7 | A | 15 | 7 | 1102 | 2.0 |
| 8 | A | 15 | 8 | 440 | 2.0 |
| 9 | A | 15 | 9 | 420 | 2.0 |
| 10 | A | 15 | 10 | 400 | 2.0 |
| 11 | A | 15 | 11 | 410 | 2.0 |
| 12 | A | 15 | 12 | 430 | 2.0 |

TABLE 2-continued

| Toner No. | Colored particle No. | Colored particle Acid value | External additive particle No. | External additive particle Iron content (ppm) | External additive particle Addition amount of toner (parts by weight) |
|---|---|---|---|---|---|
| 13 | A | 15 | 13 | 450 | 2.0 |
| 14 | A | 15 | 14 | 0 | 2.0 |
| 15 | A | 15 | 15 | 440 | 2.0 |
| 16 | A | 15 | 16 | 0 | 2.0 |
| 17 | A | 15 | 17 | 500 | 2.0 |
| 18 | A | 15 | 18 | 0 | 2.0 |
| 19 | B | 7 | 2 | 400 | 2.0 |
| 20 | C | 25 | 2 | 400 | 2.0 |
| 21 | D | 3 | 2 | 400 | 2.0 |
| 22 | E | 35 | 2 | 400 | 2.0 |

TABLE 3

| Toner No. | Colored particle No. | Colored particle Acid value | External additive particle No. | External additive particle Iron content (ppm) | External additive particle Addition amount of toner (parts by weight) |
|---|---|---|---|---|---|
| Ye1 | A | 15 | 1 | 102 | 2.0 |
| Ye2 | A | 15 | 2 | 400 | 2.0 |
| Ye3 | A | 15 | 3 | 900 | 2.0 |
| Ye4 | A | 15 | 4 | 0 | 2.0 |
| Ye5 | A | 15 | 5 | 80 | 2.0 |
| Ye6 | A | 15 | 6 | 1010 | 2.0 |
| Ye7 | A | 15 | 7 | 1102 | 2.0 |
| Ye8 | A | 15 | 8 | 440 | 2.0 |
| Ye9 | A | 15 | 9 | 420 | 2.0 |
| Ye10 | A | 15 | 10 | 400 | 2.0 |
| Ye11 | A | 15 | 11 | 410 | 2.0 |
| Ye12 | A | 15 | 12 | 430 | 2.0 |
| Ye13 | A | 15 | 13 | 450 | 2.0 |
| Ye14 | A | 15 | 14 | 0 | 2.0 |
| Ye15 | A | 15 | 15 | 440 | 2.0 |
| Ye16 | A | 15 | 16 | 0 | 2.0 |
| Ye17 | A | 15 | 17 | 500 | 2.0 |
| Ye18 | A | 15 | 18 | 0 | 2.0 |
| Ye19 | B | 7 | 2 | 400 | 2.0 |
| Ye20 | C | 25 | 2 | 400 | 2.0 |
| Ye21 | D | 3 | 2 | 400 | 2.0 |
| Ye22 | E | 35 | 2 | 400 | 2.0 |

TABLE 4

| Toner No. | Colored particle No. | Colored particle Acid value | External additive particle No. | External additive particle Iron content (ppm) | External additive particle Addition amount of toner (parts by weight) |
|---|---|---|---|---|---|
| Ma1 | A | 15 | 1 | 102 | 2.0 |
| Ma2 | A | 15 | 2 | 400 | 2.0 |
| Ma3 | A | 15 | 3 | 900 | 2.0 |
| Ma4 | A | 15 | 4 | 0 | 2.0 |
| Ma5 | A | 15 | 5 | 80 | 2.0 |
| Ma6 | A | 15 | 6 | 1010 | 2.0 |
| Ma7 | A | 15 | 7 | 1102 | 2.0 |
| Ma8 | A | 15 | 8 | 440 | 2.0 |
| Ma9 | A | 15 | 9 | 420 | 2.0 |
| Ma10 | A | 15 | 10 | 400 | 2.0 |
| Ma11 | A | 15 | 11 | 410 | 2.0 |
| Ma12 | A | 15 | 12 | 430 | 2.0 |
| Ma13 | A | 15 | 13 | 450 | 2.0 |
| Ma14 | A | 15 | 14 | 0 | 2.0 |
| Ma15 | A | 15 | 15 | 440 | 2.0 |
| Ma16 | A | 15 | 16 | 0 | 2.0 |

TABLE 4-continued

| Toner No. | Colored particle No. | Colored particle Acid value | External additive particle No. | External additive particle Iron content (ppm) | External additive particle Addition amount of toner (parts by weight) |
|---|---|---|---|---|---|
| Ma17 | A | 15 | 17 | 500 | 2.0 |
| Ma18 | A | 15 | 18 | 0 | 2.0 |
| Ma19 | B | 7 | 2 | 400 | 2.0 |
| Ma20 | C | 25 | 2 | 400 | 2.0 |
| Ma21 | D | 3 | 2 | 400 | 2.0 |
| Ma22 | E | 35 | 2 | 400 | 2.0 |

TABLE 5

| Toner No. | Colored particle No. | Colored particle Acid value | External additive particle No. | External additive particle Iron content (ppm) | External additive particle Addition amount of toner (parts by weight) |
|---|---|---|---|---|---|
| Cy1 | A | 15 | 1 | 102 | 2.0 |
| Cy2 | A | 15 | 2 | 400 | 2.0 |
| Cy3 | A | 15 | 3 | 900 | 2.0 |
| Cy4 | A | 15 | 4 | 0 | 2.0 |
| Cy5 | A | 15 | 5 | 80 | 2.0 |
| Cy6 | A | 15 | 6 | 1010 | 2.0 |
| Cy7 | A | 15 | 7 | 1102 | 2.0 |
| Cy8 | A | 15 | 8 | 440 | 2.0 |
| Cy9 | A | 15 | 9 | 420 | 2.0 |
| Cy10 | A | 15 | 10 | 400 | 2.0 |
| Cy11 | A | 15 | 11 | 410 | 2.0 |
| Cy12 | A | 15 | 12 | 430 | 2.0 |
| Cy13 | A | 15 | 13 | 450 | 2.0 |
| Cy14 | A | 15 | 14 | 0 | 2.0 |
| Cy15 | A | 15 | 15 | 440 | 2.0 |
| Cy16 | A | 15 | 16 | 0 | 2.0 |
| Cy17 | A | 15 | 17 | 500 | 2.0 |
| Cy18 | A | 15 | 18 | 0 | 2.0 |
| Cy19 | B | 7 | 2 | 400 | 2.0 |
| Cy20 | C | 25 | 2 | 400 | 2.0 |
| Cy21 | D | 3 | 2 | 400 | 2.0 |
| Cy22 | E | 35 | 2 | 400 | 2.0 |

Black Developer Preparation Examples 1-25

Carriers [a]-[c] and carriers [d]-[f] for comparative examples were mixed with respect to each of toners [1]-[22] so as to give a toner concentration of 6% by using each of the combinations shown in Table 6 to prepare black developers [1]-[15], and black developers [16]-[25] for comparative examples as two-component developers.

Yellow Developer Preparation Examples 1-25, Magenta Developer Preparation Examples 1-25, and Cyan Developer Preparation Examples 1-25

Yellow developers [1]-[15] and yellow developers [16]-[25] for comparative examples, magenta developers [1]-[15] and magenta developers [16]-[25] for comparative examples, and cyan developers [1]-[15] and cyan developers [16]-[25] for comparative examples were prepared similarly to black developer preparation examples 1-25, except that toners [1]-[22] to be employed were replaced by toners [Ye1]-[Ye22] toners [Ma1]-[Ma22] and toners [Cy1]-[Cy22], respectively. These are shown in Tables 6 and 7.

TABLE 6

| | Black developer No. | Toner No. | Carrier No. | | Yellow developer No. | Toner No. | Carrier No. |
|---|---|---|---|---|---|---|---|
| Ex. | 1 | 1 | a | Ex. | 1 | 1 | a |
| | 2 | 2 | b | | 2 | 2 | b |
| | 3 | 3 | c | | 3 | 3 | c |
| | 4 | 8 | a | | 4 | 8 | a |
| | 5 | 9 | a | | 5 | 9 | a |
| | 6 | 10 | b | | 6 | 10 | b |
| | 7 | 11 | c | | 7 | 11 | c |
| | 8 | 12 | a | | 8 | 12 | a |
| | 9 | 13 | a | | 9 | 13 | a |
| | 10 | 15 | b | | 10 | 15 | b |
| | 11 | 17 | c | | 11 | 17 | c |
| | 12 | 19 | a | | 12 | 19 | a |
| | 13 | 20 | a | | 13 | 20 | a |
| | 14 | 21 | b | | 14 | 21 | b |
| | 15 | 22 | c | | 15 | 22 | c |
| Comp. | 16 | 4 | a | Comp. | 16 | 4 | a |
| | 17 | 5 | a | | 17 | 5 | a |
| | 18 | 6 | a | | 18 | 6 | a |
| | 19 | 7 | a | | 19 | 7 | a |
| | 20 | 14 | a | | 20 | 14 | a |
| | 21 | 16 | a | | 21 | 16 | a |
| | 22 | 18 | a | | 22 | 18 | a |
| | 23 | 2 | d | | 23 | 2 | d |
| | 24 | 2 | e | | 24 | 2 | e |
| | 25 | 2 | f | | 25 | 2 | f |

Ex.: Example, and
Comp.: Comparative example

TABLE 7

| | Magenta developer No. | Toner No. | Carrier No. | | Cyan developer No. | Toner No. | Carrier No. |
|---|---|---|---|---|---|---|---|
| Ex. | 1 | 1 | a | Ex. | 1 | 1 | a |
| | 2 | 2 | b | | 2 | 2 | b |
| | 3 | 3 | c | | 3 | 3 | c |
| | 4 | 8 | a | | 4 | 8 | a |
| | 5 | 9 | a | | 5 | 9 | a |
| | 6 | 10 | b | | 6 | 10 | b |
| | 7 | 11 | c | | 7 | 11 | c |
| | 8 | 12 | a | | 8 | 12 | a |
| | 9 | 13 | a | | 9 | 13 | a |
| | 10 | 15 | b | | 10 | 15 | b |
| | 11 | 17 | c | | 11 | 17 | c |
| | 12 | 19 | a | | 12 | 19 | a |
| | 13 | 20 | a | | 13 | 20 | a |
| | 14 | 21 | b | | 14 | 21 | b |
| | 15 | 22 | c | | 15 | 22 | c |
| Comp. | 16 | 4 | a | Comp. | 16 | 4 | a |
| | 17 | 5 | a | | 17 | 5 | a |
| | 18 | 6 | a | | 18 | 6 | a |
| | 19 | 7 | a | | 19 | 7 | a |
| | 20 | 14 | a | | 20 | 14 | a |
| | 21 | 16 | a | | 21 | 16 | a |
| | 22 | 18 | a | | 22 | 18 | a |
| | 23 | 2 | d | | 23 | 2 | d |
| | 24 | 2 | e | | 24 | 2 | e |
| | 25 | 2 | f | | 25 | 2 | f |

Examples 1-15 and Comparative Examples 10

The foregoing black developers [1]-[15] and black developers [16]-[25] for comparative examples, yellow developers [1]-[15] and yellow developers [16]-[25] for comparative examples, magenta developers [1]-[15] and magenta developers [16]-[25] for comparative examples, and cyan developers [1]-[15] and cyan developers [16]-[25] for comparative examples were employed in each of the combinations shown in Table 8, and the following practical copying test was conducted employing a digital copying machine "bizhub Pro C350", manufactured by Konica Minolta Business Technologies, Inc. to evaluate image density, fog density and a color reproduction range. Results are shown in Table 9.

TABLE 8

| | Developer No. | | | |
|---|---|---|---|---|
| | Black | Yellow | Magenta | Cyan |
| Example 1 | 1 | 1 | 1 | 1 |
| Example 2 | 2 | 2 | 2 | 2 |
| Example 3 | 3 | 3 | 3 | 3 |
| Example 4 | 4 | 4 | 4 | 4 |
| Example 5 | 5 | 5 | 5 | 5 |
| Example 6 | 6 | 6 | 6 | 6 |
| Example 7 | 7 | 7 | 7 | 7 |
| Example 8 | 8 | 8 | 8 | 8 |
| Example 9 | 9 | 9 | 9 | 9 |
| Example 10 | 10 | 10 | 10 | 10 |
| Example 11 | 11 | 11 | 11 | 11 |
| Example 12 | 12 | 12 | 12 | 12 |
| Example 13 | 13 | 13 | 13 | 13 |
| Example 14 | 14 | 14 | 14 | 14 |
| Example 15 | 15 | 15 | 15 | 15 |
| Comparative example 1 | 16 | 16 | 16 | 16 |
| Comparative example 2 | 17 | 17 | 17 | 17 |
| Comparative example 3 | 18 | 18 | 18 | 18 |
| Comparative example 4 | 19 | 19 | 19 | 19 |
| Comparative example 5 | 20 | 20 | 20 | 20 |
| Comparative example 6 | 21 | 21 | 21 | 21 |
| Comparative example 7 | 22 | 22 | 22 | 22 |
| Comparative example 8 | 23 | 23 | 23 | 23 |
| Comparative example 9 | 24 | 24 | 24 | 24 |
| Comparative example 10 | 25 | 25 | 25 | 25 |

[Practical Copying Test]

A color image in which each of yellow, magenta, cyan, red, blue, green and black was composed of 1% of pixel was printed in a full-color mode for 500,000 sheets in a sheet-by-sheet intermittent mode employing an A4 size image support at a normal temperature of 20° C. and a low humidity of 10% RH, and a test image was formed on or about that. A test image at the initial stage of printing and a test image after 500,000$^{th}$ print were evaluated. The test image possesses 3 kinds of a solid white image, a solid black image, and a color image of a patch having a square, 2 cm on a side for each of yellow, magenta, cyan, red, blue and green, and these each are output one by one by using an A4-size image support. Then, the color reproduction range, image density and fog density were evaluated from the color image, solid black image and solid white image, respectively. In order to evaluate the color reproduction range, the color reproduction range area was measured from the L*a*b* color space graph obtained from a patch for each of yellow, magenta, cyan, red, blue and green employing a calorimeter CM-2002, manufactured by Konica Minolta Sensing, Inc., and the color reproduction range area of a test image after the 500,000$^{th}$ print was calculated when color reproduction range area in the case of the initial test image was set to 100. As to the image density, the absolute reflection density of a printing paper sheet was set to "0", and the absolute reflection density at each of any 10 portions of the solid black image region was measured employing a reflective densitometer "RD-918", manufactured by Macbeth Co., Ltd. to evaluate the arithmetic mean value as the image density. As to the fog density, the absolute reflection density of a printing paper sheet was set to "0", and the absolute reflection density at each of any 10 portions of the solid white image region was measured employing a reflective densitometer "RD-918", manufactured by Macbeth Co., Ltd. to evaluate the arithmetic mean value as the fog density. In addition, in the case of a color reproduction range exceeding 90, the variation in color reproduction range is sufficient. In the case of image density exceeding 1.30, sufficient image density can also be obtained. Further, in the case of a fog density of 0.005 or less, fog is practically with no problem.

TABLE 9

| | Image density | | | Fog density | | | |
|---|---|---|---|---|---|---|---|
| | At initial stage of printing | *1 | *2 | At initial stage of printing | *1 | *2 | *3 |
| Example 1 | 1.40 | 1.38 | 1.34 | 0.000 | 0.001 | 0.001 | 98 |
| Example 2 | 1.41 | 1.39 | 1.40 | 0.000 | 0.001 | 0.001 | 98 |
| Example 3 | 1.41 | 1.41 | 1.39 | 0.000 | 0.003 | 0.003 | 98 |
| Example 4 | 1.41 | 1.40 | 1.33 | 0.000 | 0.001 | 0.001 | 98 |
| Example 5 | 1.41 | 1.40 | 1.30 | 0.000 | 0.001 | 0.001 | 98 |
| Example 6 | 1.41 | 1.40 | 1.38 | 0.000 | 0.001 | 0.001 | 99 |
| Example 7 | 1.41 | 1.39 | 1.40 | 0.000 | 0.002 | 0.002 | 98 |
| Example 8 | 1.41 | 1.38 | 1.39 | 0.000 | 0.004 | 0.004 | 93 |
| Example 9 | 1.41 | 1.39 | 1.38 | 0.000 | 0.001 | 0.001 | 99 |
| Example 10 | 1.41 | 1.38 | 1.38 | 0.000 | 0.001 | 0.001 | 99 |
| Example 11 | 1.41 | 1.39 | 1.39 | 0.000 | 0.001 | 0.001 | 99 |
| Example 12 | 1.41 | 1.40 | 1.39 | 0.000 | 0.001 | 0.001 | 99 |
| Example 13 | 1.41 | 1.40 | 1.39 | 0.000 | 0.002 | 0.002 | 99 |
| Example 14 | 1.41 | 1.40 | 1.40 | 0.000 | 0.001 | 0.001 | 98 |
| Example 15 | 1.41 | 1.40 | 1.38 | 0.000 | 0.002 | 0.002 | 98 |
| Comparative example 1 | 1.40 | 1.26 | 1.08 | 0.000 | 0.004 | 0.004 | 76 |
| Comparative example 2 | 1.40 | 1.39 | 1.25 | 0.000 | 0.004 | 0.004 | 78 |
| Comparative example 3 | 1.41 | 1.41 | 1.38 | 0.000 | 0.011 | 0.011 | 87 |
| Comparative example 4 | 1.41 | 1.41 | 1.35 | 0.000 | 0.012 | 0.012 | 88 |
| Comparative example 5 | 1.40 | 1.26 | 1.12 | 0.000 | 0.002 | 0.002 | 75 |
| Comparative example 6 | 1.40 | 1.25 | 1.10 | 0.000 | 0.002 | 0.002 | 75 |
| Comparative example 7 | 1.40 | 1.24 | 1.09 | 0.000 | 0.002 | 0.002 | 76 |
| Comparative example 8 | 1.40 | 1.24 | 1.20 | 0.000 | 0.003 | 0.003 | 82 |
| Comparative example 9 | 1.40 | 1.23 | 1.15 | 0.000 | 0.005 | 0.005 | 79 |
| Comparative example 10 | 1.40 | 1.19 | 1.10 | 0.000 | 0.014 | 0.014 | 71 |

*1: After 500,000$^{th}$ print,
*2: After 1,000,000$^{th}$ print,
*3: Color reproduction range As is clear from results shown in Table 9, it is confirmed that as to Examples 1-15 relating to the two-component developer of the present invention, fog density is inhibited, sufficient image density can also be obtained, and wide color reproduction range is further achieved in the formed image, even in the case of prolonged use.

Effect of the Invention

In the case of a two-component developer of the present invention, the carrier is a resin dispersion type carrier (hereinafter, referred to also as "specific resin dispersion type carrier"). This exhibits high durability generated from high toughness caused by a high crosslinking structure in a phenol formaldehyde resin. And, the toner contains specific external additive particles, and the specific external additive particles can suppress generation of excessive electrification. That is, since the specific external additive particles serve as the effective charging site in the toner, and excessive electrification can be controlled by appropriately leaking the excessive amount of charge while obtaining an excellent charge rising property and excellent charge-holding ability for the toner via the foregoing, excessive electrification can presumably be suppressed. Then, charge buildup is inhibited by the foregoing carrier brought into contact with the toner to obtain stable developability for a long duration, whereby excellent quality images having sufficient image density can be stably formed for a long duration. Further, since the carrier has a high degree of sphericity, and exhibits specific shape with the smooth surface, a high fluidity of the carrier results, thereby maintaining even contact with the toner. Thus, the effect of further suppressing the charge buildup is produced. In the case of a two-component developer of the present invention, since the toner exhibits high electrification stability (hereinafter, referred to also as "electrification environment stability"), regardless of environmental conditions such as temperature and humidity, a stable image regardless of the environmental conditions can be formed. In addition, the reason why the charge buildup of the resin dispersion type carrier is easily generated is to be as follows. That is, the resin dispersion type carrier generally exhibits high insulation, since it contains a resin all the way to the inside. In the case of a resin-coating type carrier in which the core portion consists of a magnetic material, the conductive care present inside is possible to diffuse charge into the inside, but in the case of the resin dispersion type carrier, charge buildup is easy to be generated since the resin (one exhibiting insulation) is fully dispersed.

What is claimed is:

1. A two-component developer comprising a carrier and a toner, wherein the carrier in which magnetic material powder is dispersed in a binder resin containing a phenol formaldehyde resin has a shape coefficient SF-1 of 1.0-1.2, a shape coefficient SF-2 of 1.1-2.5 and a volume-based median particle diameter of 10-100 μm, and the toner comprises a colored particle and an external additive particle, wherein the external additive particle comprises a titanic acid compound and iron, and the iron content is 100-1,000 ppm, based on the titanic acid compound.

2. The two-component developer of claim 1, wherein the external additive particle has a BET specific surface area of 5-20 $m^2/g$.

3. The two-component developer of claim 1, wherein the external additive particle has a number average primary particle diameter of 50-2000 nm, and an sd value of the number average primary particle diameter represented by the following Equation (1) is 250 nm or less:

Equation (1): sd value (nm)=$(d_1 84-d_1 16)/2$, where $d_1 84$ and $d_1 16$ are particle diameters at which a cumulative curve obtained by setting the total value acquired via measurement of the number average primary particle diameter to 100% becomes 84% and 16%, respectively.

4. The two-component developer of claim 1, wherein the titanic acid compound comprises calcium titanate or magnesium titanate.

5. The two-component developer of claim 1, wherein the toner has an acid value of 3-35 mg·KOH/g.

* * * * *